US009041971B2

(12) United States Patent
Fukamachi

(10) Patent No.: US 9,041,971 B2
(45) Date of Patent: May 26, 2015

(54) IMAGE FORMING APPARATUS

(75) Inventor: Asuna Fukamachi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 45 days.

(21) Appl. No.: 13/486,111

(22) Filed: Jun. 1, 2012

(65) Prior Publication Data

US 2012/0320391 A1 Dec. 20, 2012

(30) Foreign Application Priority Data

Jun. 15, 2011 (JP) ..... 2011-133566

(51) Int. Cl.
*H04N 1/40* (2006.01)
*G03G 15/00* (2006.01)

(52) U.S. Cl.
CPC ..... *G03G 15/6585* (2013.01); *G03G 15/5062* (2013.01); *G03G 15/502* (2013.01)

(58) Field of Classification Search
USPC ..... 358/1.9, 2.1, 1.4, 468, 504, 406; 399/27–28, 40–41, 133, 341–342
See application file for complete search history.

(56) References Cited

U.S. PATENT DOCUMENTS

| | | | | |
|---|---|---|---|---|
| 7,324,240 | B2 * | 1/2008 | Ng | 358/1.9 |
| 7,430,389 | B2 | 9/2008 | Noguchi et al. | |
| 7,877,053 | B2 * | 1/2011 | Ng et al. | 399/341 |
| 7,941,089 | B2 | 5/2011 | Mori et al. | |
| 8,400,674 | B2 | 3/2013 | Igarashi | |
| 8,699,057 | B2 | 4/2014 | Ohno | |
| 8,736,900 | B2 | 5/2014 | Shiozawa | |
| 2005/0135851 | A1 | 6/2005 | Ng et al. | |
| 2012/0051814 | A1 | 3/2012 | Fukamachi | |

FOREIGN PATENT DOCUMENTS

| | | | |
|---|---|---|---|
| CN | 1928731 | A | 3/2007 |
| CN | 101082792 | A | 12/2007 |
| CN | 101571689 | A | 11/2009 |
| CN | 101576724 | A | 11/2009 |
| CN | 101795338 | A | 8/2010 |
| CN | 101900968 | A | 12/2010 |

(Continued)

OTHER PUBLICATIONS

Office Action in Chinese Patent Application No. 201210200687.4, dated Oct. 20, 2014.

*Primary Examiner* — Thomas D Lee
*Assistant Examiner* — Stephen M Brinich
(74) *Attorney, Agent, or Firm* — Fitzpatrick, Cella, Harper & Scinto

(57) ABSTRACT

An image forming apparatus includes an image forming portion for superposedly outputting a color toner image and a transparent toner image on a recording material; an image data obtaining portion for obtaining a color image data used for forming the color toner image and first and second transparent image data used for forming the transparent toner image; and an executing portion for executing an operation in a test mode in which a test image which collects and coordinates a predetermined number of images including a first image and a second image is outputted on the recording material smaller in number than the predetermined number. The first image is prepared by synthesizing and reducing the color image data and the first transparent image data. The second image is prepared by synthesizing and reducing the color image data and the second transparent image data different from the first transparent image data.

22 Claims, 18 Drawing Sheets

(56) References Cited

FOREIGN PATENT DOCUMENTS

| | | | |
|---|---|---|---|
| EP | 2154578 | A2 * | 2/2010 |
| JP | 4-338984 | A | 11/1992 |
| JP | 7-129039 | A | 5/1995 |
| JP | 8-220821 | A | 8/1996 |

* cited by examiner

IMAGE FORMING APPARATUS

FIELD OF THE INVENTION AND RELATED ART

The present invention relates to an image forming apparatus, such as a copying machine, a printer or a facsimile machine, for forming an image with a color toner and a transparent toner.

In recent years, an image forming apparatus of an electrophotographic type using a transparent image which becomes transparent and colorless by fixation is proposed (Japanese Laid-Open Patent Publication (JP-A) Hei 8-220821). By using the transparent toner, various representations can be made, so that added value of an output product is improved. For example, in an image forming apparatus described in JP-A Hei 4-338984, glossiness of a print is selectively increased by selectively placing the transparent toner on a designated region. Thus, by adjusting the glossiness of an image, it became possible to provide the added value which could not be conventionally obtained by only color toners of colors such as yellow, magenta, cyan and black.

For example, a portion with high glossiness is partly formed on a gradation image such as a photographic image and an illustration image, so that emphasized representation can be made. Further, uses such as subdued representation with low glossiness and photographic representation with high glossiness as a whole depending on the output product would be considered.

Further, a technique for forming and fixing, on a recording material on which an image is once formed and fixed, another image is disclosed (JP-A Hei 7-129039). According to this technique, the previously formed image passes through a fixing device two times and therefore the glossiness thereof is increased, so that the glossiness of the subsequently formed image appears to be relatively low. For this reason, an output product is different in glossiness be the previously formed image and the subsequently formed image. Further, use of only the transparent toner for forming the image on not only the recording material subjected to color image formation by the image forming apparatus provided with the transparent toner but also the recording material subjected to image formation by the color image forming apparatus provided with no transparent toner is also desired.

However, in the case where the image is formed with the transparent toner, the present inventor noticed that the glossiness varies depending on the type of media (recording material), an amount of the transparent toner and an amount of the color toner and therefore an effect of the transparent toner expected by a user is not necessarily obtained.

For example, in the technique described in JP-A Hei 8-220821, in some cases, a transparent toner image-formed portion formed depending on an image pattern appears to be low gloss relative to another portion depending on the type (glossiness) of the recording material such as highly-glossy paper although a degree of the low gloss varies depending on the glossiness of the formed transparent image. Or, even when the transparent toner image-formed portion appears to be high gloss, the expected effect of the transparent toner cannot be obtained in some cases depending on the transparent image pattern. In these cases, such an operation that the recording material is outputted by increasing the transparent toner amount or by changing the transparent image pattern has to be repeated.

Further, in the case where the recording material has already been subjected to the toner image formation (recording) as in JP-A Hei 7-129039, there is a disadvantage such that an original on which the transparent toner is intended to be placed (coated) is consumed correspondingly to the repetition of the above described operation.

SUMMARY OF THE INVENTION

In view of the circumstances described above, a principal object of the present invention is to provide an image forming apparatus capable of quickly forming an image with an effect of a transparent toner desired by a user.

According to an aspect of the present invention, there is provided an image forming apparatus comprising: an image forming portion for superposedly outputting a color toner image and a transparent toner image on a recording material; an image data obtaining portion for obtaining a color image data to be used for forming the color toner image and first and second transparent image data to be used for forming the transparent toner image; and an executing portion for executing an operation in a test mode in which a test image which collects and coordinates a predetermined number of images including a first image and a second image is outputted on the recording material smaller in number than the predetermined number, wherein the first image is prepared by synthesizing and reducing the color image data and the first transparent image data which are obtained by the image data obtaining portion, and the second image is prepared by synthesizing and reducing the color image data and the second transparent image data different from the first transparent image data.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a), (b) and (c) of FIG. 1 are schematic views each showing an example of an image forming apparatus according to an embodiment of the present invention.

Figure 3:
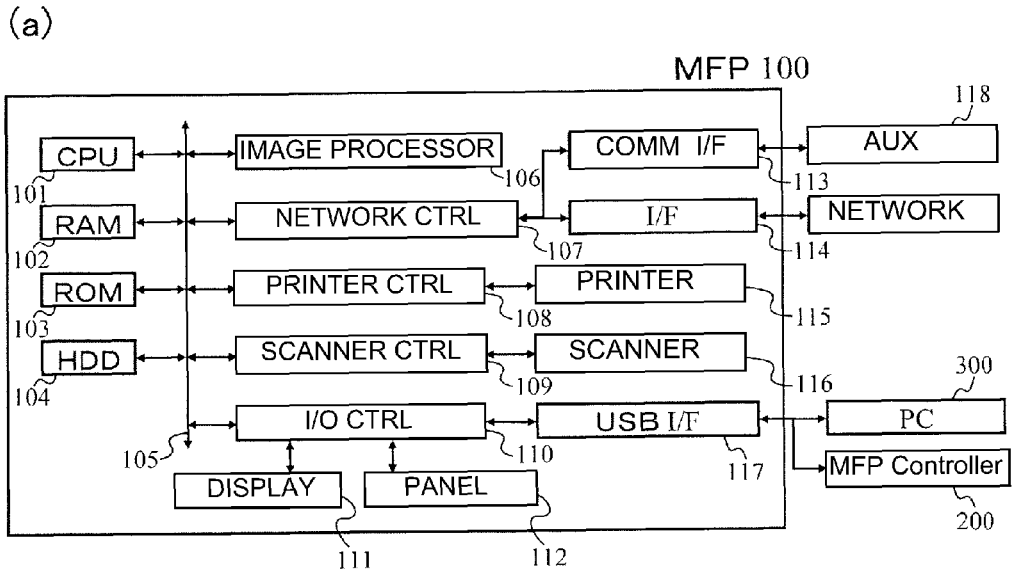
Figure 3:
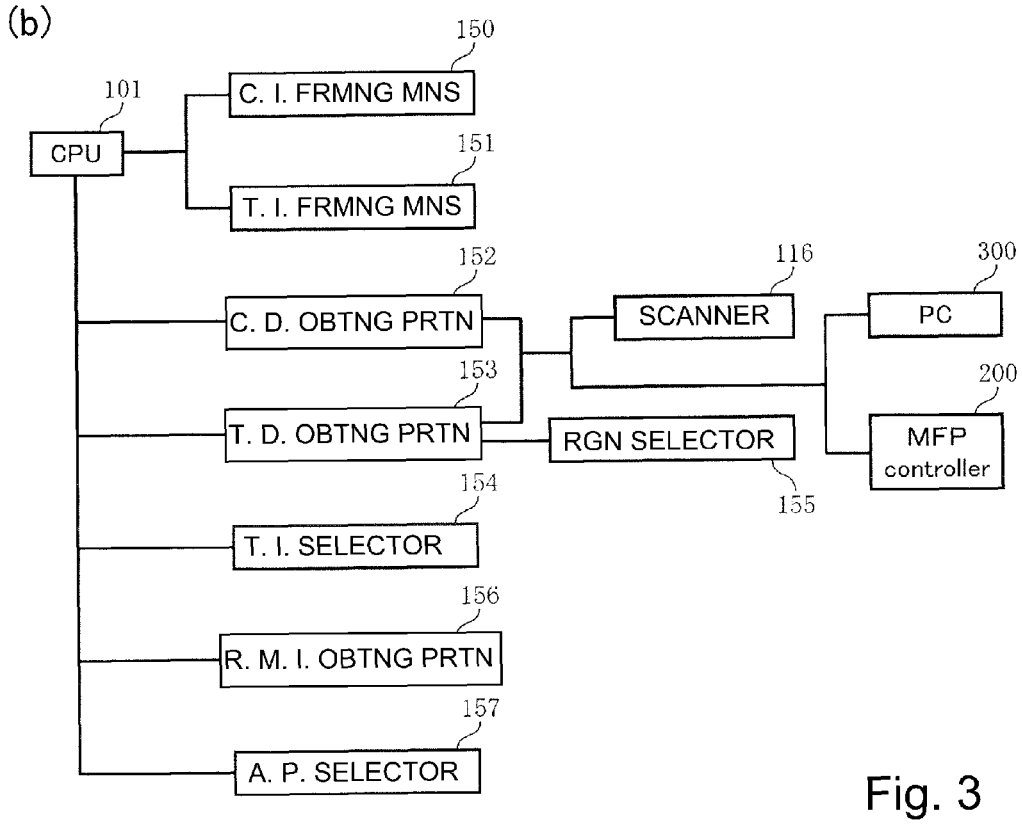

Part (a) of FIG. 3 is a block diagram of an MFP (multifunction peripheral) constituting the image forming apparatus in First Embodiment, and (b) of FIG. 3 is a block diagram for illustrating control of an operation in a test mode and control for outputting an image selected in the operation in the test mode.

Figure 4:
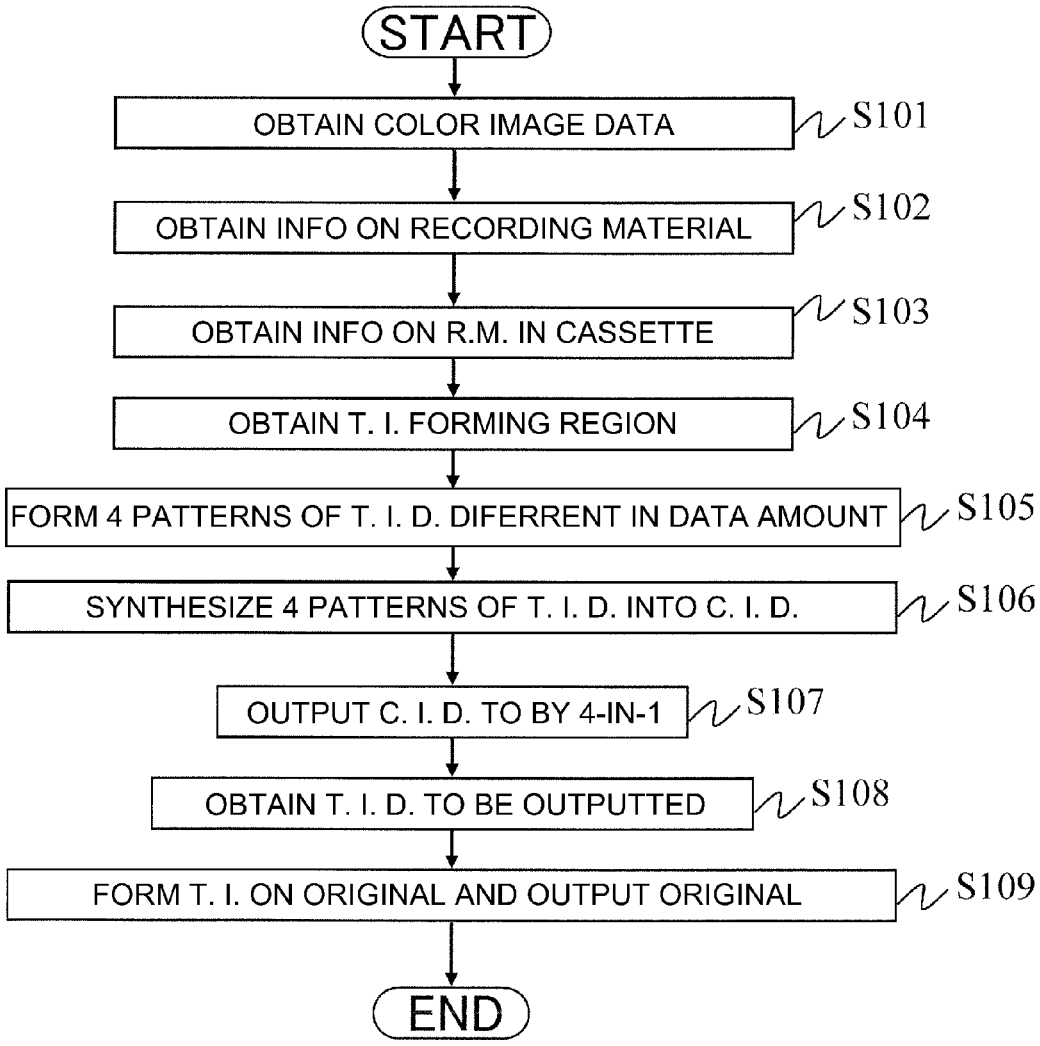

FIG. 4 is a flow chart of the control of the operation in the test mode and the control for outputting the image selected in the operation in the test mode in First Embodiment.

FIGS. 5 to 11 are schematic views showing first to seventh setting screens, respectively, of the image forming apparatus in First Embodiment.

Figure 12:
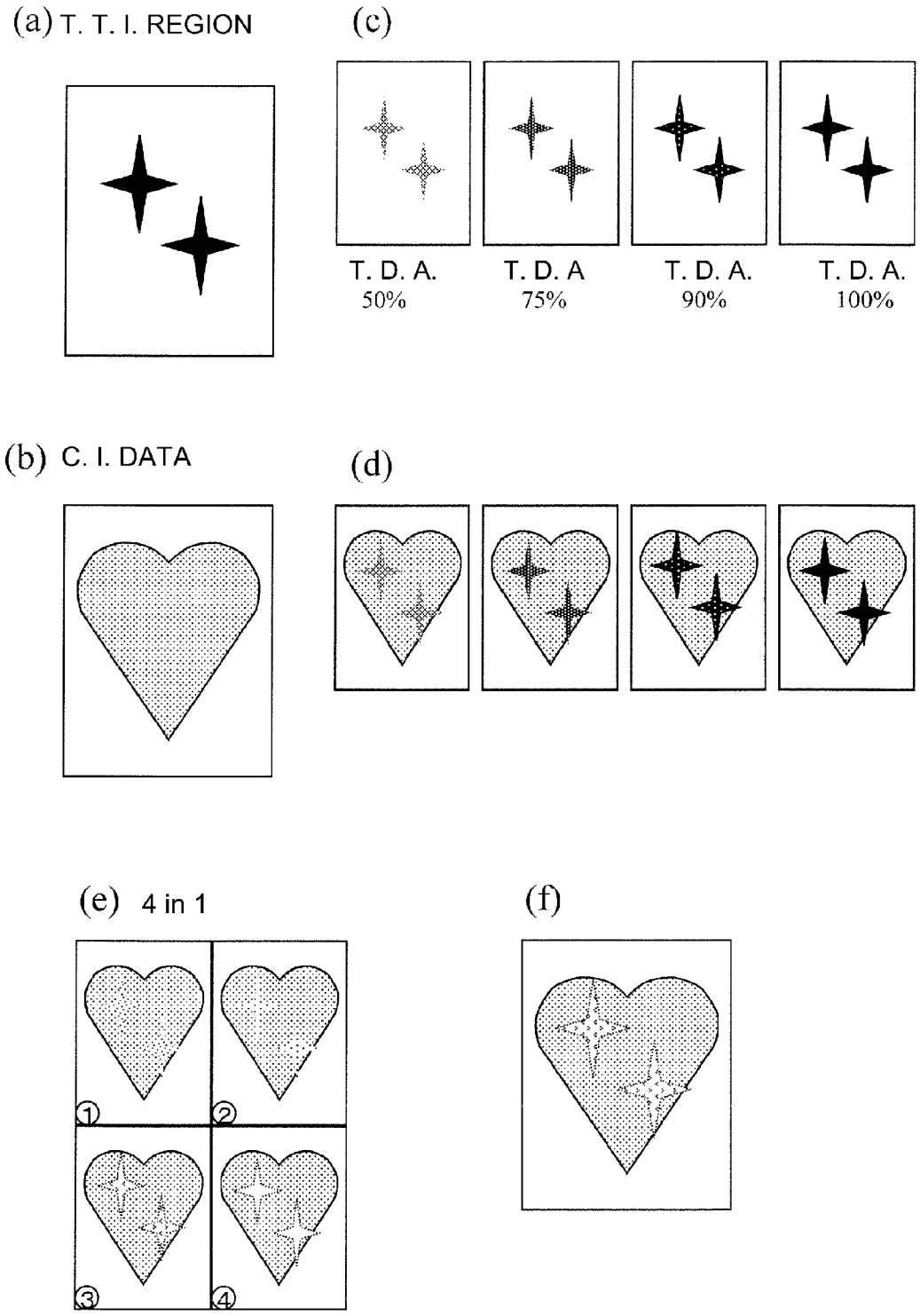

Parts (a) to (f) of FIG. 12 are schematic views for illustrating the control of the operation in the test mode and the control for outputting the image selected in the operation in the test mode in First Embodiment.

Figure 13:
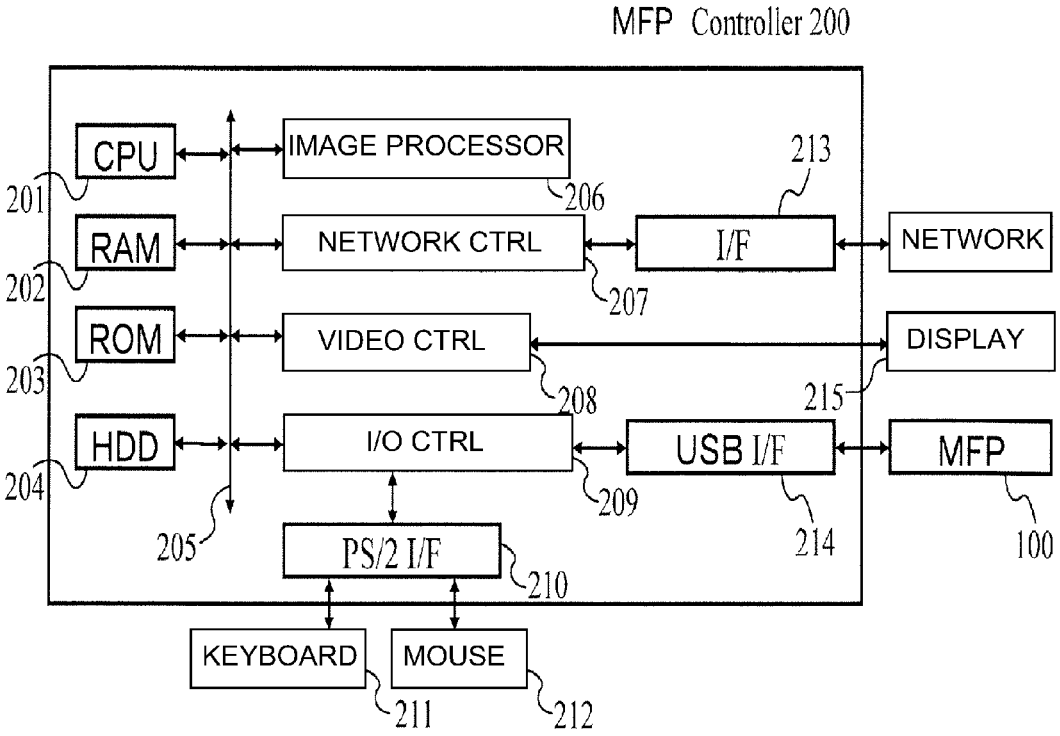

FIG. 13 is a block diagram of an MFP controller constituting an image forming apparatus in Second Embodiment.

Figure 14:
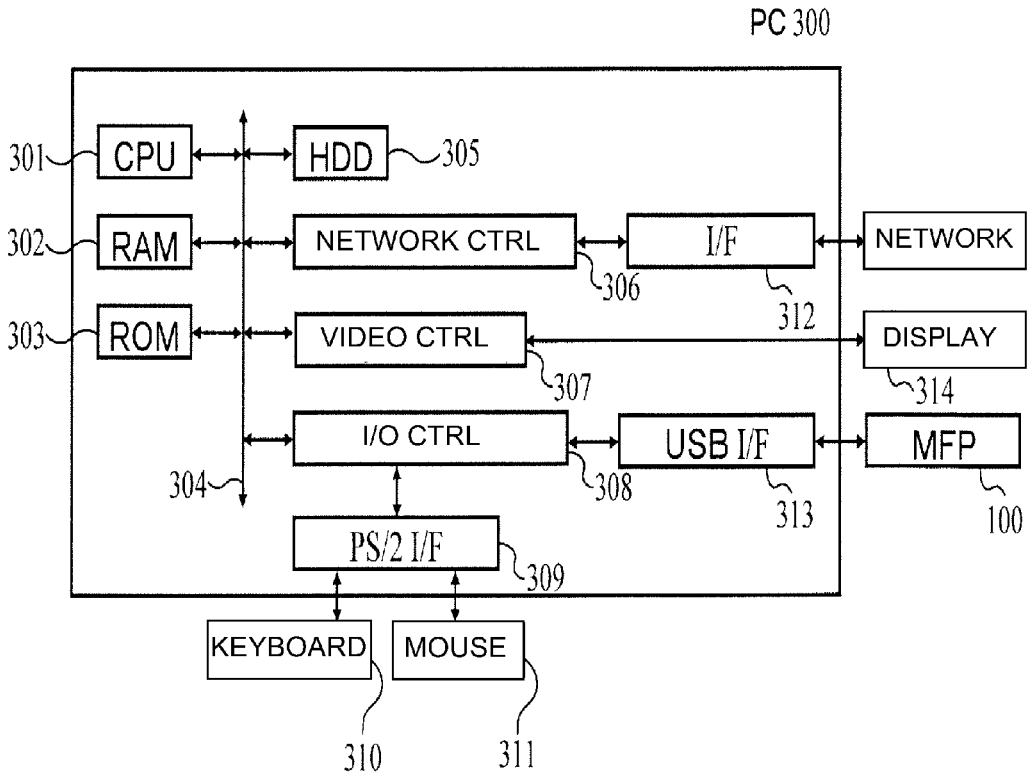

FIG. 14 is a block diagram of a PC (personal computer) constituting the image forming apparatus in Second Embodiment.

Figure 15:
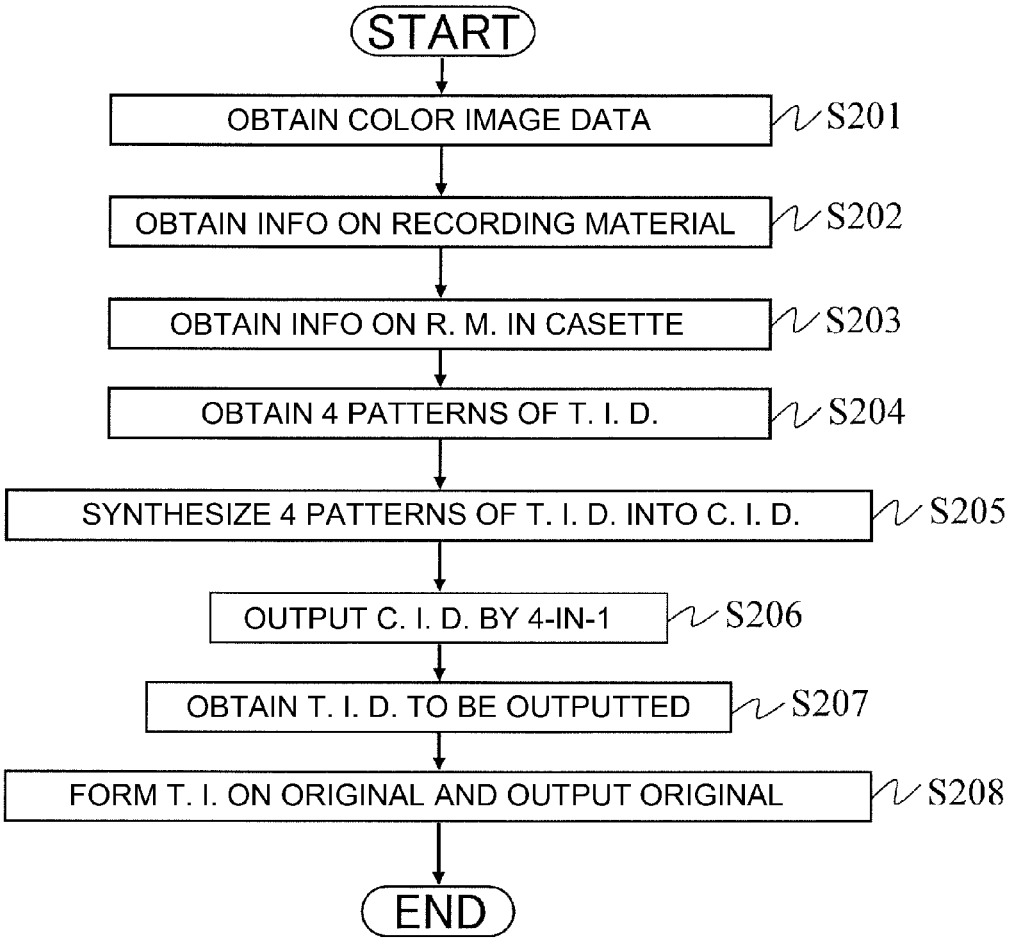

FIG. 15 is a flow chart of control of an operation in a test mode and control for outputting an image selected in the operation in the test mode in Second Embodiment.

Figure 16:
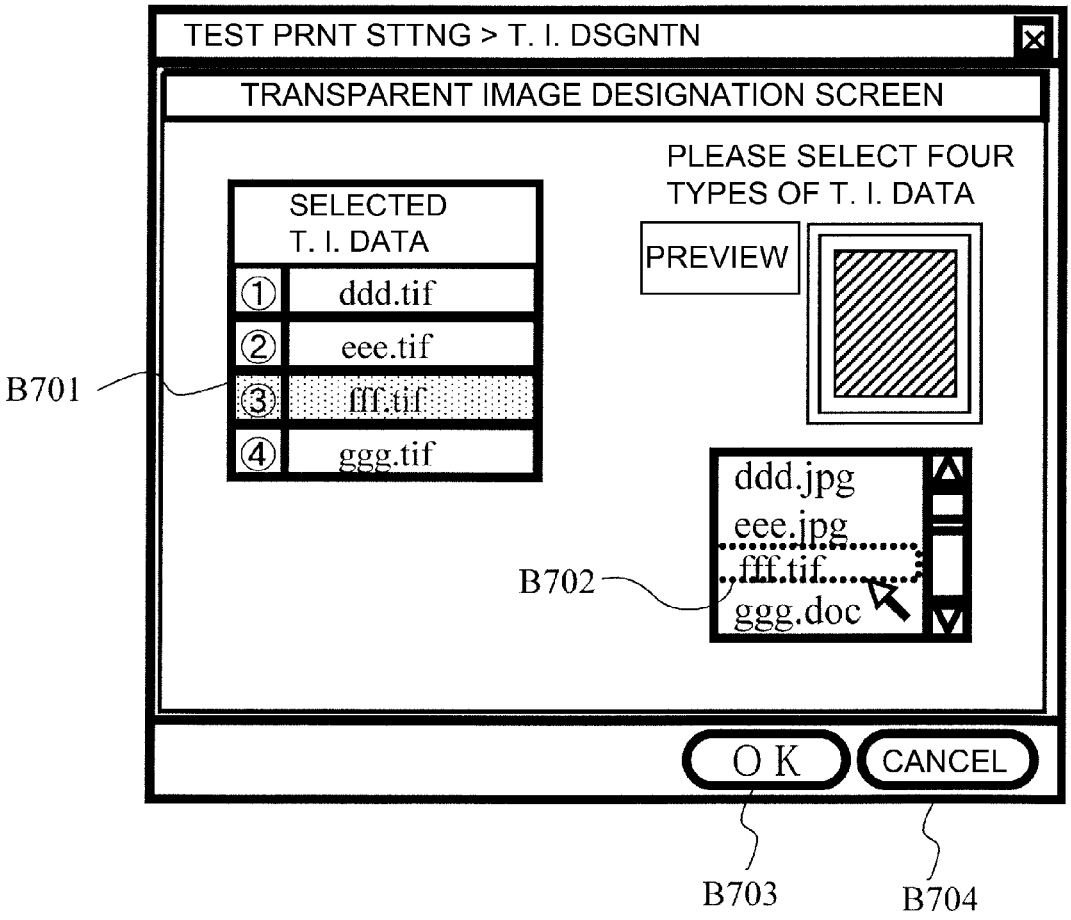
Figure 17:
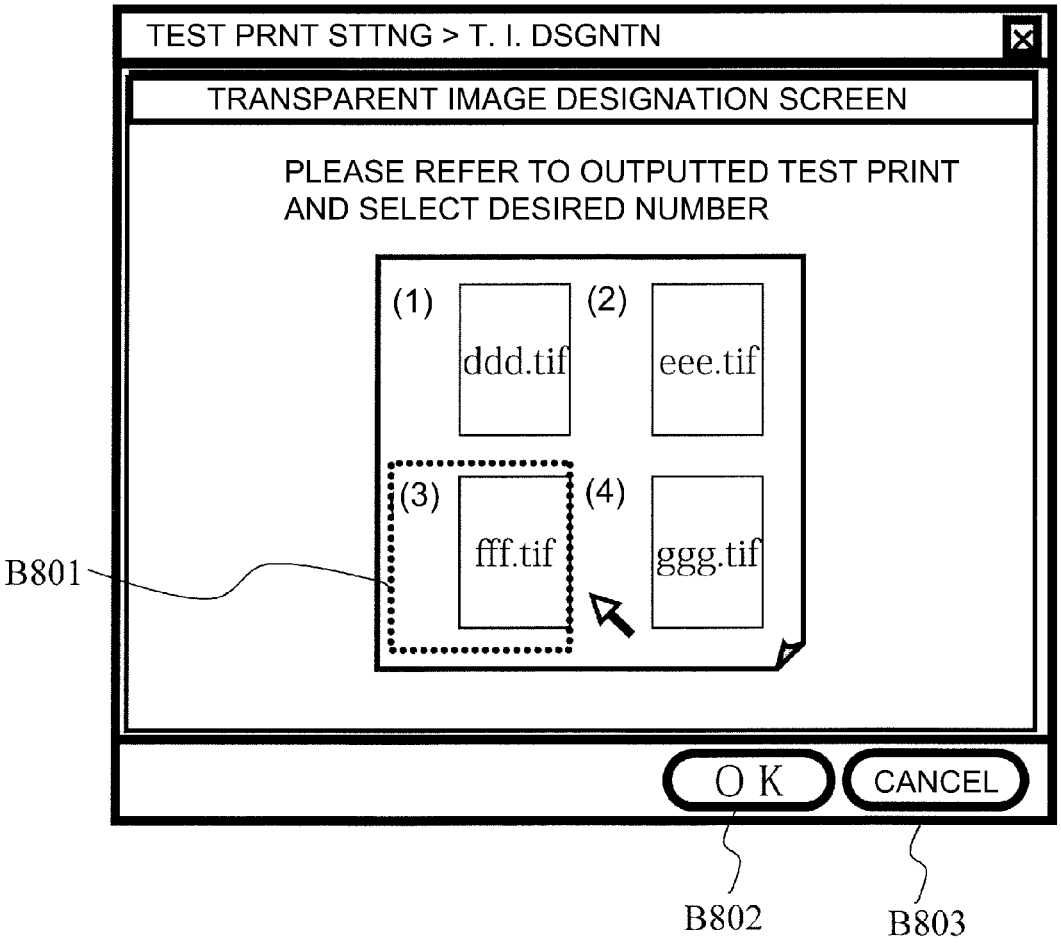

FIGS. 16 and 17 are schematic views showing first and second setting screens, respectively, of the image forming apparatus in Second Embodiment.

Figure 18:
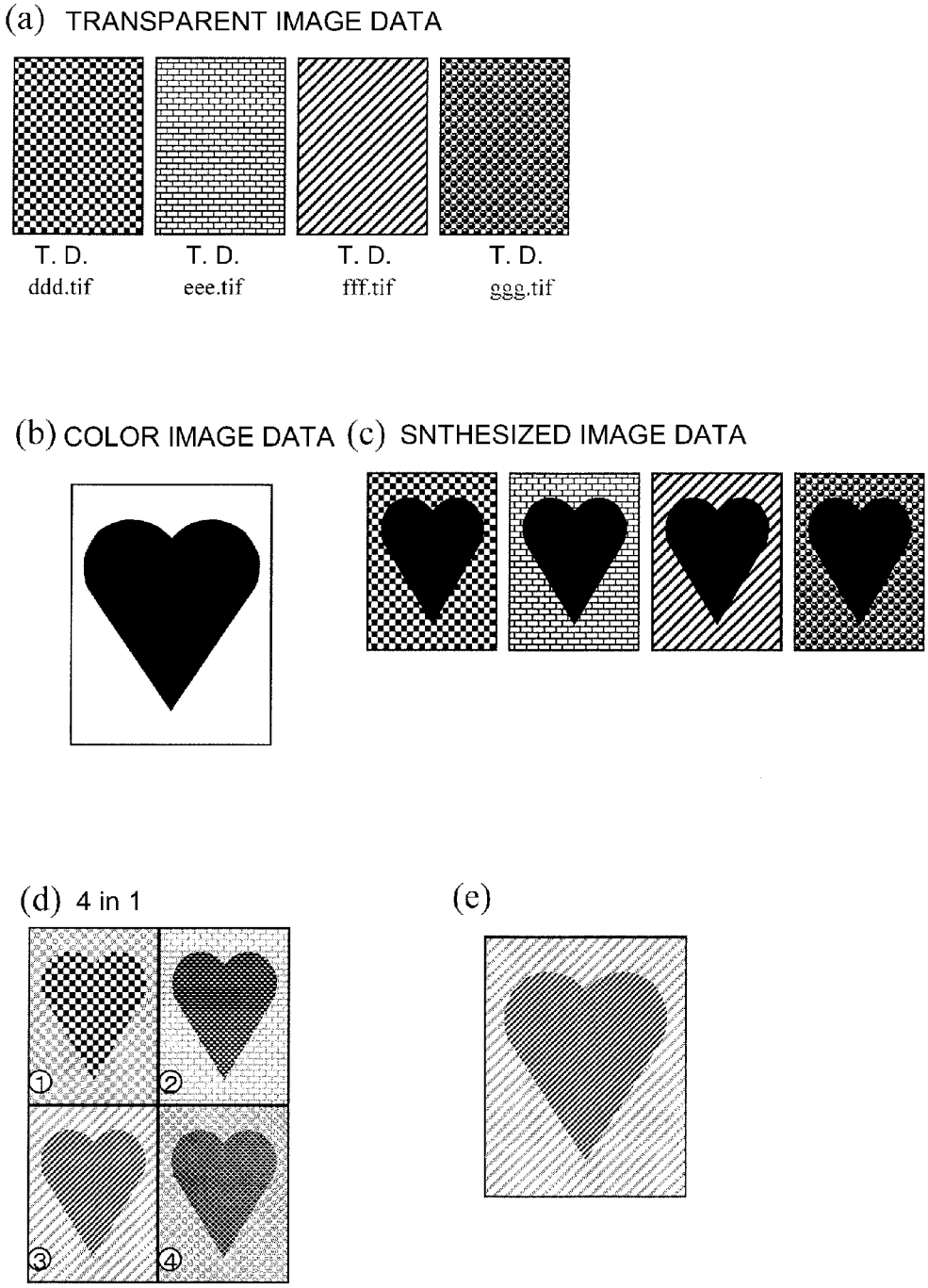

Parts (a) to (e) of FIG. 18 are schematic views for illustrating the control of the operation in the test mode and the control for outputting the image selected in the operation in the test mode in Second Embodiment.

DESCRIPTION OF THE PREFERRED EMBODIMENTS

Hereinbelow, with reference to the drawings, embodiments of the present invention will be exemplarily described in detail. However, dimensions, materials, shapes and relative configurations of constituent elements described in the following embodiments should be appropriately changed depending on constitutions and various conditions of image forming apparatuses to which the present invention is applied. Therefore, unless otherwise noted specifically, the scope of the present invention is not limited to those in the following embodiments.

First, a system constitution of the image forming apparatus will be described. Then, respective constituent elements constituting the system will be described. Thereafter, an operation of the system will be described along a flow chart. Hereinafter, an image processing system refers to an information processing system for generating image data used for printing at a printer portion 115 ((a) of FIG. 3) as an image forming portion. Further, an image forming system refers to the image processing system including the printer portion 115. Further, an apparatus which includes a CPU (central processing unit) as an information processing circuit and is operated in accordance with a program is referred to as an information processing apparatus. Further, in the case where the information processing apparatus processes the image in accordance with the program, the information processing apparatus is referred to as an image processing apparatus.

(System Constitution of Image Forming Apparatus)

First, three examples of the system constitution of the image forming apparatus according to the present invention will be described with reference to (a), (b) and (c) of FIG. 1. The system of the image forming apparatus is either one of the following three apparatuses including at least an MFP 100. A first is the MFP 100 as an image forming apparatus main assembly. A second is an MFP controller 200 as an external controller. A third is a PC 300 as an information processing apparatus. The PC, the MFP and the MFP controller which constitutes the image forming system are connected with each other directly or through a network in a communicatable manner.

Figure 1:
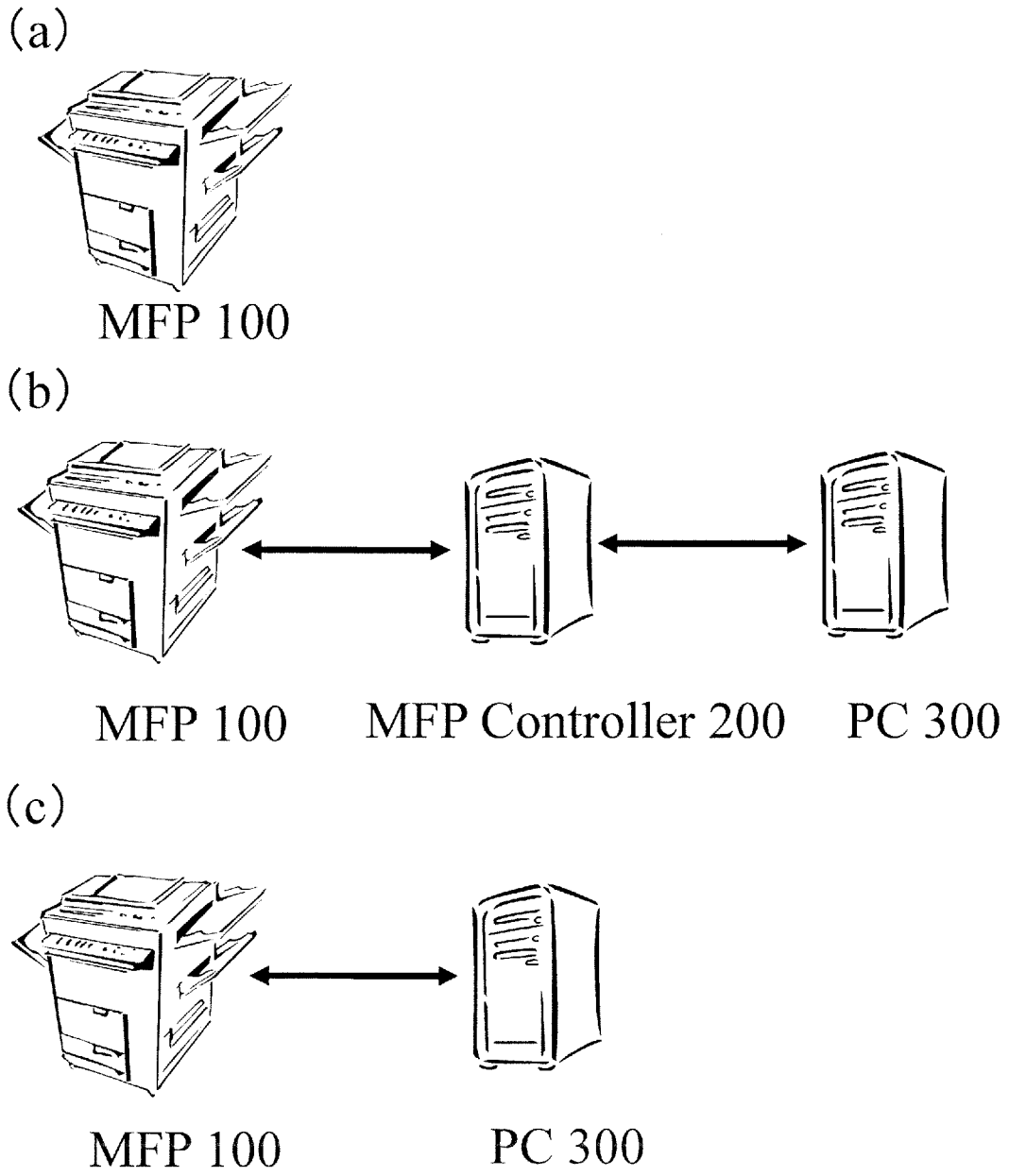

First, in the constitution shown in FIG. 1(*a*), image processing and image formation are effected by the MFP 100 alone. In such a constitution, the user operates an operating panel 112 (FIG. 2) of a main assembly of the MFP 100, so that the user can transmit a print instruction to the MFP 100. In the constitution, the image processing is executed by a CPU 101 ((a) and (b) of FIG. 3) and a dedicated image processing circuit 106 ((a) of FIG. 3) which are provided inside the MFP 100 main assembly.

Next, in the constitution shown in FIG. 1(*b*), the PC 300 is connected to the MFP 100 through the MFP controller 200 in a communicatable manner. In such a constitution, the user can send the print instruction to the MFP controller 200 by operating the PC 300. In the constitution, the image processing is effected by a CPU 201 (FIG. 13) and a dedicated image processing circuit 206 (FIG. 13) which are provided inside the MFP controller 200.

Finally, in the constitution shown in FIG. 1(*c*), the PC 300 is connected to the MFP 100 in a communicatable manner. In such a constitution, the user can send the print instruction to the MFP 100 by operating the PC 300. In the constitution, the image processing is effected by a CPU 301 (FIG. 14) provided inside the PC 300.

The respective apparatuses constituting the above-described image forming system effect communication with each other in accordance with Ethernet (registered trademark) standard standardized by IEEE 803.2 standard. The above-described examples of the image forming system are merely illustrative and therefore the image forming system in the present invention is not limited thereto.

<First Embodiment>

Next, First Embodiment of the present invention will be described with reference to FIG. 2 to FIG. 12. In this embodiment, the present invention is applied to the above-described constitution of (a) of FIG. 1. That is, the image forming apparatus of the present invention is constituted by the MFP 100 alone. First, the MFP 100 will be described with reference to FIG. 2.

[MFP]

The MFP 100 includes a printer portion 115, a scanner portion 116, a display 111, an operating panel 112 and the like. The printer portion 115 constitutes a color multi-function machine, using an intermediary transfer member, having a copying (copier) function and a printing (printer) function. At an upper surface of the printer portion 115, the scanner portion 116 and the display 111 are provided. The scanner portion 116 optically scans an original placed on an original supporting platen glass to read an image of the original by photoelectric color separation. The image information of the original read by the scanner portion 116 is image-processed and depending on image-processed data, exposure units of respective colors are controlled. At the display 111, a screen for inputting information on glossiness of a recording material used in the MFP 100, a screen for inputting a region where a user wishes to partly and relatively enhance the glossiness with a transparent toner, and the like screen are displayed. Through the operating panel 112, input of image forming mode setting and designation by the user, notification to the user of an apparatus state, and the like are made.

[Scanner Portion]

Further, the scanner portion 116 which is an image reading portion is constituted by an image sensor as a photoelectric conversion element for reading the original image (image formed on the recording material), an original carriage and an ADF (automatic document feeder). Further, the image data of the original set on the original carriage or the ADF is obtained by the image sensor. The image data obtained by the scanner portion 116 is sent to a scanner controller 109 as shown in (a) of FIG. 3. The scanner controller 109 is capable of sending the image data obtained by the scanner portion 116 to respective connected portions via a bus 105.

[Printer Portion]

Inside the printer portion 115, five (first to fifth) image forming portions Pa, Pb, Pc, Pd and Pe are provided side by side in the substantially horizontal direction. At an upper side of the image forming portions Pa, Pb, Pc, Pd and Pe, laser scanning mechanisms (exposure devices) 11*a*, 11*b*, 11*d* and 11*e* are provided, respectively. At a lower side of the image forming portions Pa, Pb, Pc, Pd and Pe, an intermediary transfer belt mechanism is provided. Below the intermediary transfer belt mechanism, a sheet feeding cassette 80 is provided. Further, at a side surface of the printer portion 15, a manual-feeding tray 2 and a deck 60 are provided. Further, at a downstream side of the intermediary transfer belt mechanism with respect to a recording material conveyance direction, a fixing device 50 for heating toner images formed on the recording material to fix the toner images on the recording material is provided.

[Structure of Image Forming Portion]

As described above, in the printer portion 115, the five image forming portions Pa, Pb, Pc, Pd and Pe are juxtaposed. In this embodiment, a structure in which four image forming portions Pa, Pb, Pc and Pd using color toners of yellow (Y), magenta (M), cyan (C) and black (Bk), respectively, and one image forming portion Pe using a clear (transparent) (T) toner are juxtaposed is illustrated as an example.

The first to fifth image forming portions Pa, Pb, Pc, Pd and Pe have the same electrophotographic process constitution (structure). For this reason, in the following description, suffixes, a, b, c, d and e for representing constituent members for the image forming portions of the respective colors are omitted and the constituent members of the respective colors will be collectively described. Each image forming portion includes a photosensitive drum 1 which is an electrophotographic photosensitive member as an image bearing member. Further, the image forming portion includes process means, acting on the photosensitive drum 1, such as a whole-area exposure lamp (charge-removing lamp), a primary charger 22, the laser scanning mechanism (exposure device) 11, the developing device 23 and a drum cleaner 12. In the developing devices of the respective image forming portions, color toners of yellow (Y), magenta (M), cyan (C) and black (Bk) and the transparent toner of clear (T) are filled by associated supplying devices.

Further, an intermediary transfer belt 30 as an intermediary transfer member is rotatably provided so as to contact the photosensitive drum 1. The intermediary transfer belt 30 is extended around a follower roller 25, a secondary transfer opposite roller 29, and a driving roller 26 driven by a driving motor. Further, at an opposing position to the photosensitive drum 1 via the intermediary transfer belt 30, a primary transfer roller 24 is provided. The follower roller 25 also functions as a tension roller, thus having the function of providing a predetermined tension to the intermediary transfer belt 30. The secondary transfer opposite roller 29 is disposed opposite to a secondary transfer roller 40 described later via the intermediary transfer belt 30. Further, to the secondary transfer opposite roller 29, a secondary transfer bias (voltage) is applied from a high-voltage power source during the secondary transfer.

Further, below the intermediary transfer belt 30, a sheet feeding cassette 80 for stacking and accommodating sheets of the recording material is provided, and the recording material fed by an unshown pick-up roller is conveyed toward a registration roller 3 via a plurality of conveying rollers (roller pair) 7.

[Fixing Device]

Here, the fixing device 50 provided at the printer portion 115 will be described specifically. In the fixing device 50, each of a fixing roller 51 and a pressing roller 52 is rotatably shaft-supported. The fixing roller 51 has a three-layer structure which concentrically includes a core portion, an elastic layer and a parting layer. The core portion is constituted by, e.g., an aluminum hollow pipe of 44 mm in diameter and 5 mm in thickness. The elastic layer is constituted, e.g., a silicone rubber layer of 50 degrees in JIS-A hardness and 2.5 mm in thickness. The parting layer is constituted by, e.g., a PFA layer of 50 μm in thickness. Inside the hollow pipe of the core portion, a halogen lamp as a heat source (heater for heating the roller) is provided.

Also the pressing roller 52 has, similarly as in the fixing roller 51, has the three-layer structure consisting of the core portion, the elastic layer and the parting layer. However, the elastic layer may preferably be increased in thickness by using, e.g., a 3 mm-thick silicone rubber layer. This is because a width of a fixing nip can be ensured by the elastic layer. Inside the hollow pipe of the core portion of the pressing roller 52, the halogen lamp as the heat source (heater for heating the roller) is provided.

The fixing roller 51 and the pressing roller 52 are press-contacted with a predetermined pressure to form the fixing nip as a heating and pressing portion with a predetermined width. The pressure for the pressing roller 52 is, e.g., 588 N (60 kgf) as a total pressure. In this case, the width of the fixing nip is 7 mm.

The fixing roller 51 and the pressing roller 52 are rotationally driven in a predetermined direction by a driving motor (not shown) while being press-contacted to each other. Each of the heaters is supplied with electric power from a power source circuit (not shown) to generate heat. Each of the fixing roller 51 and the pressing roller 52 is internally heated by the heat generation of the heater. An 800 W-heater and a 500 W-heater were used for the fixing roller 51 and the pressing roller 52, respectively. Further, a surface temperature of each of the fixing roller 51 and the pressing roller 52 is monitored by a temperature sensor, such as thermistor, contacted to the associated roller, and electrical information on a detected temperature is inputted into a fixing controller (not shown).

The fixing controller, controls, on the basis of the inputted information, the electric power supplied from the power source circuit to the heater so that the surface temperature (fixing temperature) of each of the fixing roller 51 and the pressing roller 52 can be kept at a predetermined control temperature. That is, the fixing roller 51 and the pressing roller 52 are temperature-controlled at predetermined temperatures, so that the temperature of the fixing nip is temperature-controlled at a predetermined fixing temperature. In this embodiment, the fixing temperature of the fixing roller 51 is set at 180° C. and the fixing temperature of the pressing roller 52 is set at 150° C. These rollers are temperature-controlled by a control device so as to keep the fixing temperatures.

A fixing roller cleaner 53 of a web type wipes and cleans the surface of the fixing roller 51. A pressing roller cleaner 54 of a web type wipes and cleans the surface of the pressing roller 52. The web of each of the cleaners 53 and 54 is a heat-resistant cleaning member.

The fixing roller 51 and the pressing roller 52 are rotationally driven and are internally heated to be increased in surface temperature to predetermined associated control temperatures, respectively, thus being temperature-controlled. In this state, a recording material P on which unfixed toner images are formed is introduced from the intermediary transfer belt mechanism into the fixing device by a conveying belt. Then, during nip-conveyance of the recording material P through the fixing nip, the recording material P is heated by the fixing roller 51 and the pressing roller 52 and is pressed under the nip pressure. As a result, superposed toner images of the four colors of yellow, cyan, magenta and black or of the five colors of clear (transparent) in addition to the four colors are melt-mixed to be fixed, as a color image, on the surface of the recording material P.

The recording material P coming out of the fixing nip is separated from the fixing roller 51 or the pressing roller 52 by a separation claw (not shown) and is relayed to a fixing discharge roller 56, thus being sent out of the fixing device.

Incidentally, a process speed at which the recording material passes through the fixing device is controlled at, e.g., 285 mm/s.

[Image Forming Operation]

An operation for forming the color image is as follows. The first to fifth image forming portions Pa, Pb, Pc, Pd and Pe are successively driven with predetermined control timing. By the drive, the drum 1 of each of the image forming portions is rotated in the counterclockwise direction. Further, the intermediary transfer belt 30 is also rotationally driven in the clockwise direction. The laser scanning mechanism is also driven. In synchronism with this drive, the primary charger 22 uniformly charges the surface of the photosensitive drum 1 to a predetermined polarity and a predetermined potential. The laser scanning mechanism 11 subjects the surface of the photosensitive drum 1 to laser beam scanning exposure depending on an image signal. As a result, an electrostatic latent image corresponding to the image signal is formed on the surface of the photosensitive drum 1. The formed electrostatic latent image is developed as the toner image by the developing device 23.

In this embodiment, by the above-described electrophotographic operation, a yellow toner image is formed on the peripheral surface of the photosensitive drum 1*a* of the first image forming portion Pa. A magenta toner image is formed on the peripheral surface of the photosensitive drum 1*b* of the second image forming portion Pb. A cyan toner image is formed on the peripheral surface of the photosensitive drum 1*c* of the third image forming portion Pc. A black toner image is formed on the peripheral surface of the photosensitive drum 1*d* of the fourth image forming portion Pd. A transparent (clear) toner image is formed on the peripheral surface of the photosensitive drum 1*e* of the fifth image forming portion Pe.

The respective color toner images formed on the respective photosensitive drums 1 are primary-transferred onto the intermediary transfer belt 30 so as to be successively superposed by applying a primary transfer bias to the primary transfer roller 24, so that a full-color toner image is formed.

On the other hand, the sheets of the recording material P are selectively separated and fed one by one from any one of the sheet feeding cassette 80, the manual-feeding tray 2 and the deck 60. Then, the recording material is conveyed toward the registration roller 3 via the plurality of conveying rollers 7. The registration roller 3 has the function of controlling a recording material sending timing so that timing when the toner images on the intermediary transfer belt 30 enter the secondary transfer portion coincides with timing when the recording material enters the secondary transfer portion.

Then, a secondary transfer bias is applied to the secondary transfer roller 40, so that the toner images on the intermediary transfer belt 30 are secondary-transferred collectively onto the recording material P sent into the secondary transfer portion. The recording material P on which the toner images are transferred in the above-described manner is conveyed toward the fixing device 50. Incidentally, the intermediary transfer belt 30 from which the recording material P is separated is cleaned by a belt cleaner 21.

The recording material P separated from the intermediary transfer belt 30 is guided into the fixing device 50 by the conveying belt. The recording material P guided in the fixing device 50 enters the fixing nip which is the press-contact portion between the fixing roller 51 and the pressing roller 52 to be nip-conveyed, so that the recording material P is heated and pressed and thus color-mixing of and fixation on the recording material P of the respective color toner images are made. Thus, on the recording material P, a color image or an image including the color image and a transparent image superposed on the color image is formed.

[Conveyance Path]

At a downstream position of the fixing device 50, a selector 10 as a recording material conveyance path-switching means is provided. The selector 10 is capable of switching the recording material conveyance path (direction) between a conveyance path A along which the recording material is discharged to the outside of the image forming apparatus and a re-conveyance path B.

Figure 2:
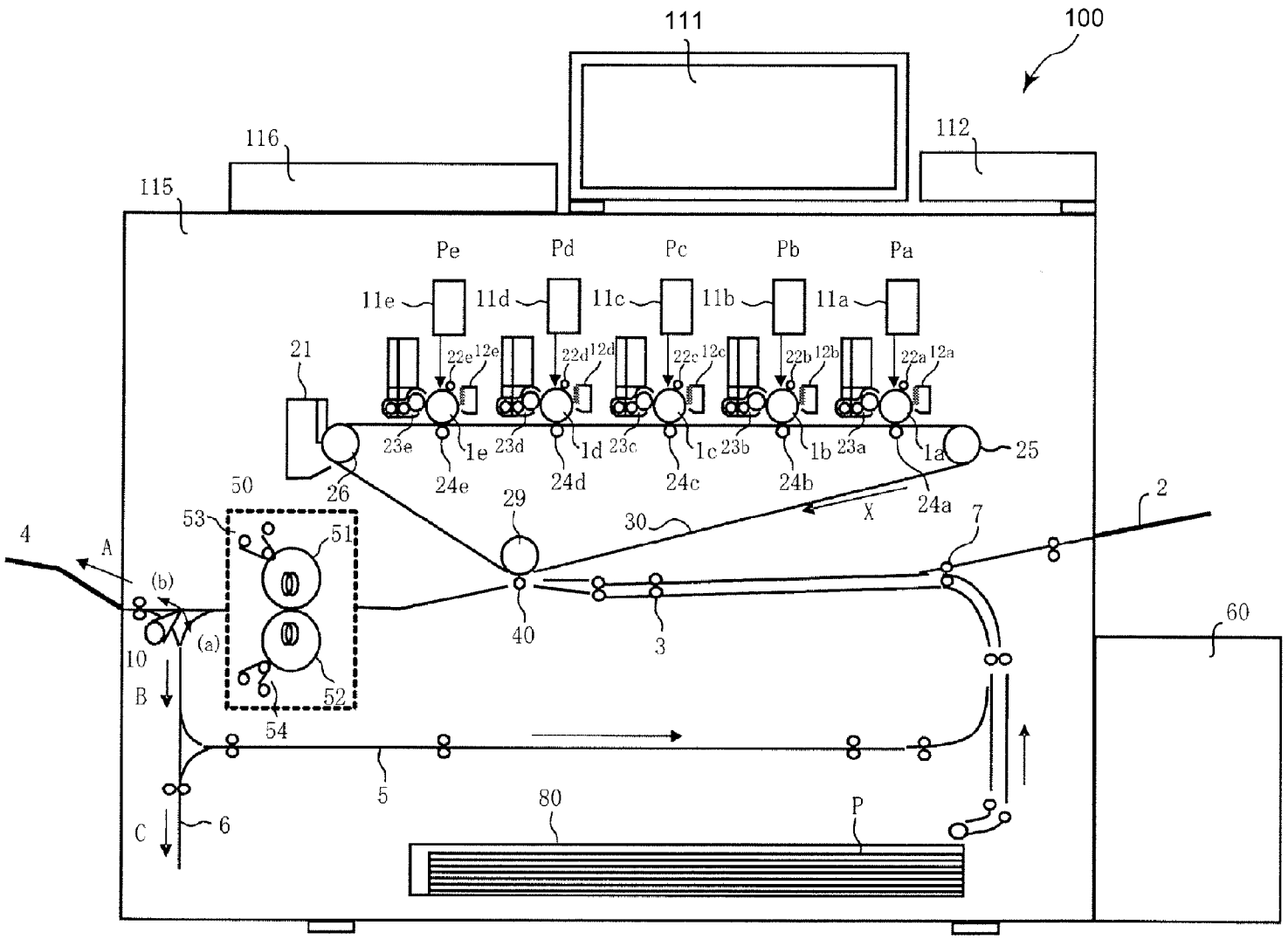
FIG. 2 is a schematic sectional view of a structure of an image forming apparatus according to First Embodiment.

In the case where the image formation is effected on only one surface (one side) of the recording material, the recording material P which is subjected to the image formation (recording) and then comes out of the fixing device 50 is guided into the conveyance path A by the selector 10 switched to (a) indicated in FIG. 2 and then is discharged onto the discharge tray 4 disposed outside the image forming apparatus.

In the case where an operation in a double-side image forming mode is selected, in the apparatus main assembly 100, the recording material P which comes out of the fixing device 50 and has already been subjected to the image formation on a first surface is changed in movement direction to the re-conveyance path B by the selector 10 switched to (b) indicated in FIG. 2. Then, by a reversing path (switch-back path) C located downstream of the re-conveyance path B, the recording material P is turned upside down to be sent to both-side conveyance path 5. The reversed recording material P is sent from a feeding roller, driven with predetermined control timing, toward the registration roller 3. From the registration roller 3, the recording material P is sent to the secondary transfer portion again in a state in which a second surface is directed upward. Then, the four color toner images for the full-color image or the transparent images consisting of these four color toner images and a transparent toner image are transferred from the intermediary transfer belt 30 onto the second surface of the recording material P. The recording material P subjected to the toner image formation on the second surface is conveyed into the fixing device 50 and then is subjected to the toner image fixation on the second surface thereof. The recording material P coming out of the fixing device 50 is guided to the conveyance path A by the selector 10 switched to (a) indicated in FIG. 2 and then is discharged onto the discharge tray 4 provided outside the image forming apparatus.

[Constitution for Separately Forming Color Images and Transparent Image]

In the above description, the case where the toner images of the color toners and the toner image of the transparent toner are superposedly fixed on the recording material is described but in the case of this embodiment, the toner image of only the transparent toner can be formed on the recording material separately from the toner images of only the color toners. In this case, a color image forming means is constituted by a group of constituent portions, for forming the color images on the recording material with the color toners, such as the four image forming portions Pa, Pb, Pc and Pd using the color toners (including the black toner), the intermediary transfer belt mechanism, the fixing device, the cassette and the conveyance paths. On the other hand, a transparent image forming means is constituted by a group similar to the above group for the color image forming means except that the four image forming portions, Pa, Pb, Pc and Pd are replaced with the (single) image forming portion Pe using the transparent toner.

In such a constitution, the case of internal automatic multiple fixation such that first fixation is made after first image formation is effected with only the color toners and thereafter second image formation and second fixation are effected with only the transparent toner will be described. First, the full-color toner image is formed on the recording material P by using the image forming portions Pa, Pb, Pc and Pd and then is fixed by the fixing device 50, so that the color image is formed on the recording material P. Thereafter, the recording material P is conveyed to the conveyance path 5 without being turned upside down. The conveyed recording material P is fed from the feeding roller, driven with predetermined control timing, toward the registration roller 3 and then is sent to the secondary transfer portion again. Then, the transparent image formed on the intermediary transfer belt 30 by the image forming portion Pe is superposedly transferred onto the color image formed on the recording material P. The recording material P subjected to the toner image formation on its second surface is conveyed into the fixing device 50, in which the recording material P is subjected to the transparent image fixation on its second surface. The recording material P coming out of the fixing device 50 is guided to the conveyance path A by the selector 10 switched to (a) indicated in FIG. 2, thus being discharged onto the discharge tray 4 provided outside the image forming apparatus.

Further, in this embodiment, the recording material on which the color image is formed may also be discharged to the outside of the image forming apparatus. Further, the recording material on which the color image is formed in advance is set on the manual-feeding tray 2 and then the transparent image can also be superposedly formed on the color image on the recording material.

[Toner]

Next, the toner accommodated in the developing device of each image forming portion will be described.

In this embodiment, the color toner is principally constituted by a polyester resin material and a pigment. Further, the transparent toner is principally constituted by the polyester resin material. Incidentally, the transparent toner appears to be colorless and clear by being subjected to heating and fixation. However, the transparent toner which is not yet fixed can appear to be white due to light scattering depending on its particle size. Incidentally, as a toner manufacturing method, it is possible to use a pulverization method and a method (polymerization method), for manufacturing directly toner particles in a medium, such as a suspension polymerization method, an interfacial polymerization method or a dispersion polymerization method. In this embodiment, the toner manufactured by using the suspension polymerization method was used. Incidentally, the toner components and the toner manufacturing method are not limited to those described above.

Further, the transparent toner and the color toners, used in this embodiment, have a glass transition point (Tg) of about 55° C. In this embodiment, the transparent toner was manufactured so that the glass transition point (Tg), a main binder, an amount of addition of a wax and formulation of an external additive were substantially identical to those for the color toners. For that reason, in the case where the same fixing condition and the substantially same toner amount per unit area are employed for the transparent toner and the color toners, the color toners fixed on the recording material and the transparent toner fixed on the recording material have the substantially same glossiness. In this embodiment, the transparent toner and the color toners which have the same glass transition point were used.

Next, the amount of the toner will be described. As the image data inputted into the image forming portion, data from 0 to 255 of 600 dpi subjected to color separation of the image of the original into Y, M, C and Bk(K). This data per (one) pixel is referred to as an image data amount. A maximum image data amount is represented as 100%. Depending on the image data amount from 0% to 100%, the amount of the toner to be subjected to the image formation is calculated. The toner amount refers to the amount of the toner per pixel to the image formation on the recording material. The toner amount is also represented by 0% to 100% similarly as the image data amount. The weight of the toner in the case where the image is formed at 1 $cm^2$ is referred to as a toner amount per unit area. When the toner amount for a single color is 100%, the toner amount is a maximum toner amount per unit area for the (single) color and provides a maximum (image) density. In the case of the transparent toner, the glossiness, not the density becomes an index. The maximum density and the glossiness are determined depending on image design, a toner characteristic, a fixing condition of the fixing device, the type of the recording material, and the like.

In this embodiment, the maximum toner amount per unit area of each of the color toner and the transparent toner was 0.5 $mg/cm^2$. In this case, when the image was formed with the transparent toner on "A CO. G.C.P.B.W. (A company, gloss coated paper, basis weight) 157 $g/m^2$" and subjected to 60 degree-gloss measurement with the toner amount per unit area of 0.5 $mg/cm^2$, the glossiness of 40% was obtained. A glossiness was measured by using a handy glossimeter ("PG-1M", mfd. by Nippon Denshoku Industries, Co., Ltd.) in accordance with JIS Z 8741 (specular glossiness measuring method).

(Hardware Configuration of MFP)

A hardware configuration of the MFP 100 will be described with reference to (a) of FIG. 3. The MFP 100 is constituted by the controller, the scanner portion, and the printer portion. The respective portions will be described below in detail.

(Controller)

A CPU 101, an RAM (random access memory) 102, and an ROM (read only memory) 103 are connected to a bus 105. Similarly, a HDD (hard disk drive) 104, a dedicated image processing circuit 106, a network controller 107, a printer controller 108, a scanner controller 109, and an I/O controller 110 are connected to the bus 105. The various units connected to the bus 105 can communicate with each other through the bus 105.

In such a constitution, the CPU 101 as the control means sends control instructions or the like, through the bus 105, to the HDD 104, the network controller 107, the printer controller 108, the scanner controller 109, and the I/O controller 110. Further, the CPU 101 receives, through the bus 105, a state indicating signal or data such as image data from the HDD 104, the network controller 107, the printer controller 108, the scanner controller 109, and the I/O controller 110. Thus, the CPU 101 can control the various units constituting the MFP 100. Operations of the respective units will be described more specifically.

The CPU 101 and the dedicated image processing circuit 106 expand a program stored in, e.g., the ROM 103 into a primary memory which is called registry present in the CPU 101 or the dedicated image processing circuit 106 and execute the program. The RAM 102 is shared and used as a secondary memory needed during execution of the program by the CPU 101 or the dedicated image processing circuit 106. The HDD 104 having a larger storage capacity than that of the ROM 103 is principally used for storing the image data held in the MFP 100. The network controller 107 is a processing circuit for communicating with external equipment, and modulates and converts signals sent from the CPU 101 into signals in accordance with various standards. In this embodiment, the network controller 107 converts the sent signals into multi-valued signals in accordance with IEEE 803.2 standard and sends the signals to a network through an I/F 114. Further, the network controller 107 demodulates the multi-valued signals sent from the network through the I/F 114 and sends the signals to the CPU 101. As a result, the MFP 100 may communicate with the MFP controller 200 or the PC 300 through the network. Similarly, the network controller 107 converts a signal sent from the CPU 101 into a signal in accordance with ARCNET (attached resource computer network) standard and sends the signal to an auxiliary device 118 through an auxiliary I/F 113. Further, the network controller 107 demodulates a signal received from the auxiliary device 118 and sends the signal to the CPU 101. As the auxiliary device 118, e.g., a finisher (not shown) for effecting post-processing such as stapling, the paper deck 60 as an auxiliary sheet feeding device, and the like may be used. Picture data sent from the CPU 101 to a printer portion 115 as an image forming portion through the printer controller 108 is image data. Therefore, when a PDL (page description language) is inputted from the PC 300 to the MFP 100, the CPU 101 and the dedicated image processing circuit execute RIP (raster image processing) in a shared manner. Incidentally, the PDL is a programming language for instructing a picture image to be outputted to the MFP 100. Advantages of the PDL is that graphics can be held as vector data independent of a resolution of the printer and that an amount of data in the case of a simple line image can be made smaller than that of the image data. On the other hand, by using the PDL, the PDL is required to be re-converted into map image data needed during output at the printer portion, so that processing therefore incurs overhead. Such a processing for converting the PDL into the image data is referred to as the RIP. In this way, the image data converted from the PDL by the RIP is sent to the printer portion 115 through the printer controller 108. The printer portion 115 outputs a print on the basis of the received image data. Incidentally, the printer controller 108 controls the printer portion 115 on the basis of the externally inputted image data so that a toner image corresponding to the image data can be fixed on the recording material. Such a printer controller 108 controls the printer portion 115 on the basis of the image data sent from the MFP controller 200 in a constitution shown in (b) of FIG. 1. Further, in a constitution shown in (c) of FIG. 1, the printer controller 108 controls the printer portion 115 on the basis of the image data sent from the PC 300.

The scanner controller 109 controls an original image reading operation of an image sensor provided at a lower portion of an original carriage provided to a scanner portion 116 and an operation of an ADF (automatic document feeder). A user sets originals on the original carriage one by one when the image data of the original is read by the MFP 100. The scanner controller 109 receives original reading instructions and actuates the image sensor provided at the lower portion of the original carriage to scan the original surface, thus obtaining image data of the original set on the original carriage. Further, the user can provide instructions to set a plurality of sheets of the originals and to read image data from the plurality of sheets. As a result, the ADF feeds one of the plurality of sheets of the originals to the image sensor portion. Then, the ADF feeds one of the plurality of sheets, excluding the sheet which has already been fed to the image sensor portion, to the image sensor portion, thus repeating this operation until the feeding of the plurality of sheets of the originals is completed. As a result, it is possible to automatically and successively read the image data from the originals set to the ADF. Thus, in the case subjecting a large amount of the originals to scanning, it is possible to save the user from placing the plurality of sheets of the originals on the original carriage one by one.

In a case where a box mode for storing an image in the HDD 104 provided in the MFP 100 is selected, the scanner controller 109 stores the image data obtained by the scanner portion 116 in the HDD 104. In the case where a copy mode for outputting the image data, obtained by the scanner portion 116, from the printer portion 115, is selected, the scanner controller 109 sends the image data obtained by the scanner portion 116 to the printer controller 108. As a result, the printer controller 108 outputs the received image data to the printer portion 115.

The I/O controller 110 communicates with the PC 300 or the MFP controller 200 through a USB (universal serial bus) I/F 117. Further, the I/O controller 110 is connected to a display 111 as a displaying means and an operation panel as an input means. The CPU 101 can obtain information inputted from the operation panel by the user through the I/O controller 110. Further, the I/O controller 110 displays information selectable by the user or information indicating a state of the MFP 100 on the display 111. On the display 111, a screen into which information on glossiness of the recording material to be used in the MFP 100 is to be input, a screen into which information on an area in which the glossiness is intended to be partly and relatively increased by using transparent toner is to be input, and the like screen are displayed.

[Test Mode]

Next, a constitution for executing an operation in a test mode in this embodiment will be described with reference to (b) of FIG. 3. First, in the operation in the test mode, when a predetermined effect is obtained by selectively forming the transparent image on the color image, a recording material on which a plurality of types of transparent images are formed on the color image is outputted. The user can select a desired image from the plurality of types of the images by executing the operation in the test mode.

For this reason, in this embodiment, such a constitution as shown in (b) of FIG. 3 is employed. The constitution shown in (b) of FIG. 3 is constituted by any of the constitutions shown in FIG. 2 and (a) of FIG. 3 or an appropriate combination of the constitutions. As the constitutions for executing the operation in the test mode, a color image forming means 150, a transparent image forming means 151, a color data obtaining portion 152, a transparent data obtaining portion 153, a transparent image selecting portion 154 and the like are cited.

Of these, the color image forming means 150 is, as described above, the four image forming portions Pa, Pb, Pc and Pd using the color toners, the intermediary transfer belt mechanism, the fixing device, the cassette, the conveyance paths. Further, the color images are formed with the color toners on the recording material. The transparent image forming means 151 is, as described above, constituted by the same members or portions as those of the color image forming means 150 except that the image forming portions Pa, Pb, Pc and Pd are replaced with the image forming portion Pe using the transparent toner, and forms the transparent toner with the transparent toner on the recording material.

The color data obtaining portion 152 obtains color image data from the scanner portion 116, the PC 300 or the MFP controller 200. For example, from the image data of the original read by the scanner portion 116, the data of 0 to 255 of 600 dpi color-separated into color data of C, M, Y and Bk(K) of the image of the original are obtained. The representative color data obtained by the color data obtaining portion 152 are stored in a predetermined memory.

The transparent data obtaining portion 153 obtains a plurality of types of transparent image data, e.g., different in toner amount in a predetermined image area (region). That is, the transparent data obtaining portion 153 obtains a plurality of data which have the same image but have different values of the glossiness. The plurality of data may also be those different in image itself or those different in both of the image and the toner amount. These data are accommodated in advance in a memory of the MFP 100, the PC 300 or the MFP controller 200. The data may also be obtained through the internet or read by the scanner portion 116.

In this embodiment, the transparent data obtaining portion 153 obtains the plurality of data which have the same image itself (e.g., a pattern) but have different values of glossiness (toner amount per unit area). Further, this image (predetermined image region) is selectable from the plurality of types of images (image regions). The plurality of types of image designates are stored in the memory of the MFP 100 in advance and are obtained by the transparent data obtaining portion 153 by being selected by an image region selecting portion 155. The transparent data obtaining portion 153 stores the plurality of types of image regions in a predetermined memory, on the basis of the data of the image region selected by the image region selecting portion 155, as the plurality of data different in toner amount determined in advance or selected by the user.

The transparent image selecting portion 155 selects any of the transparent image data from the plurality of types of transparent image data obtained by the above-described transparent data obtaining portion 153. For example, the user selects the transparent image data by operating the operating panel 112.

The CPU 101 as the control means controls the color image forming means 150, the transparent image forming means 151, the color data obtaining portion 152, the transparent data obtaining portion 153, the scanner portion 116, the image region selecting portion 155 and the transparent image selecting portion 154. Further, in the operation in the test mode, a plurality of synthesized images are outputted on the recording material smaller in number (e.g., one sheet) than the plurality of types of the transparent image data.

First, by the color image forming means 150, on the basis of the color image data obtained by the color data obtaining portion 152, the color images which are the same in number as that of the plurality of types of transparent image data is reduced in size and then are formed on the recording material which is smaller in number than the color images. The plurality of types of transparent image data are obtained by the transparent data obtaining portion 153. Next, by the transparent image forming means 151, transparent images based on the plurality of types of transparent image data are reduced in size and then superposedly formed on the plurality of color images, so that the resultant images are outputted as a plurality of synthetic images.

For example, in the case where the plurality of types of the transparent image data are 4 types of transparent image data and the number of sheets of the recording material to be outputted in the operation in the test mode is one sheet of A4-sized recording material, 4 color images are formed in the operation in the test mode. In this case, these 4 color images are formed on the recording material so that the 4 color images are reduced in size and are disposed uniformly on one sheet of the A4-sized recording material. Next, the 4 types of transparent images are reduced in size with the same magnification as that for the color images. As a result, one sheet of the recording material, a plurality of synthetic images (sample images) in which the plurality of different transparent images are superposed on the color images are formed. For example, 4 types of synthetic images different in glossiness are formed.

Incidentally, in this embodiment, a plurality of accommodating portions are constituted by the manual-feeding tray 2, the cassette 80 and the deck 60. Further, in the cassette 80 and the deck 60, the recording materials different in material (type) are accommodated.

Further, in the case where the recording material information obtaining portion 156 is provided and the color images are read by the scanner portion 116, information of the recording material on which the color images are formed is obtained. Such a recording material information obtaining portion 156 obtains information inputted, e.g., by an operation of the operating panel 112 by the user.

In the operation in the test mode, by an accommodating portion selecting portion 157, the recording material corresponding to the recording material information obtained by the recording material information obtaining portion 156 can be selected as the recording material on which the above-described sample image is to be formed. That is, the accommodating portion selecting portion 157 compares the preliminarily inputted information of the recording materials accommodated in the cassette 80 and the deck 60 with the recording material information obtained by the recording material information obtaining portion 156. Then, when the recording material which is the same as the recording material on which the color images are formed is present in the accommodating portion of the cassette 80 or the deck 60, the accommodating portion selecting portion 157 selects the recording material in the accommodating portion as the recording material on which the sample images are to be formed.

On the other hand, when the recording material which is the same as the recording material on which the color images are formed is not present in both of the cassette 80 and the deck 60, the accommodating portion selecting portion 157 selects a recording material closest in feature (material) to the recording material on which the color images are formed. Alternatively, the user is notified of the absence of the associated recording material and thus the user can be urged to set the recording material for the sample images on the manual-feeding tray 2. Incidentally, the selection of the recording material closest in feature to the recording material on which the color images are formed may also be made by the user, e.g., so that the recording material having a basis weight closest to that of the recording material on which the color images are formed. In either case, the sample images are formed on the recording material which is the same in feature as or closest in feature to the recording material on which the color images are formed.

The user selects a desired image by directly viewing the plurality of synthetic images (sample images) outputted as described above. In this case, the transparent image selecting portion 154 is capable of selecting the transparent image data corresponding to the synthetic image selected from the plurality of synthetic images outputted in the operation in the test mode. For example, a screen showing positions of the portion synthetic images formed on the recording material is displayed on the display 111. The transparent image selecting portion 154 associates the positions of the plurality of synthetic images formed on the recording material with positions of those displayed on the display 111. Then, the user selects, through the operating panel 112, the position on the display 111 corresponding to the position of the synthetic image selected from the plurality of synthetic images outputted in the operation in the test mode, so that the transparent image data corresponding to the synthetic image desired by the user is selected. When the transparent image data desired by the user is selected, an actual image is outputted by using this transparent image data.

For example, in the case where the select transparent images are intended to be formed on an original on which the color images are formed, the original is set on the manual-feeding tray 2 and then the transparent images are formed on this original. On the other hand, in the case where the color images are newly formed and thereon the selected transparent images are formed, the image is formed on the recording material which is the same as the recording material outputted in the operation in the test mode. For example, first, the color images are formed by the color image forming means 150 and thereafter the transparent images are formed on the color images by the transparent image forming means 151.

[Example of Flow of Processing in Operation in Test Mode]

Processing effected by using such an operation in the test mode is made along a flow (chart), e.g., as shown in FIG. 4.

In this embodiment, the image processing which is characteristic processing is executed by the CPU 101 of the MFP 100. An image processing operation performed by the MFP as the information processing apparatus in accordance with a program stored in the ROM 103 will be described below. Here, the description will be made with a view to explain how the information processing apparatus operates in accordance with the program, so that a detailed image forming operation will be described later.

Incidentally, as a processing method of generating the image data used for forming the color image at the printer portion (hereinafter referred to as color image data), a known method is used unless otherwise specified.

S101 represents a step for obtaining information indicating a "color image data for which transparent images are intended to be synthesized" designated by the user. The CPU 101 obtains the information on the color image data for which toner images are intended to be synthesized by the color image data obtaining portion 152 as a color image data information obtaining means. The CPU 101 holds the obtained (color image data) information in the RAM 102.

S102 represents a step for obtaining information on the recording material. The CPU 101 obtains the information on the recording material, on which the transparent images are synthesized, by the recording material information obtaining portion 156. Here, the obtained recording material information refers to the type of the recording material (on which the color images for which an effect of the transparent images is intended to be obtained are formed) of the original. The CPU 101 holds the obtained recording material information in the RAM 102.

S103 represents a step for obtaining information on the cassette 80 and the deck 60. The CPU 101 obtains, as a cassette information obtaining means, the information on each of the recording materials applied in the cassette 80 and the deck 60. Here, the obtained recording material information refers to the type of the recording material. The CPU 101 holds the obtained recording material information for each of the cassette and deck in the RAM 102.

S104 represents a step for obtaining information indicating a region in which the transparent image designated by the user is intended to be formed. The CPU 101 obtains the information indicating the region, in which the transparent image is desired to be formed by the user, by the transparent data obtaining portion 153 as a region information obtaining means. The CPU 101 holds the obtained (region information) in the RAM 102.

In a step S105, the CPU 101 as an image data generating means executes generating processing of the transparent image data of a plurality of patterns (from patterns in this embodiment). The transparent image data of the four patterns are used for forming the transparent images, with an image data amount of the four patterns, in the region obtained in the step S104. Incidentally, the four patterns are formed in this embodiment but the number of the patterns is not limited to four. For example, six patterns or eight patterns may also be formed.

In a step S106, the CPU 101 executes, as an image data generating means, generating processing of synthetic sample image data. The synthetic sample image data refers to sample image data, for being outputted as the sample images, obtained by synthesizing the transparent image data of the four patterns generated in the step S105 on the color image data obtained in the step S101. In this embodiment, four images are formed on one sheet of the recording material (4-in-1 manner) by reducing each of the four images in size.

In a step S107, the sample image data generated in the step S106 are set to the printer portion, so that the recording material on which the transparent toner images and the color toner images are formed and fixed on the basis of the synthetic sample image data is outputted. The cassette for this recording material is the cassette in which the recording material corresponding to the recording material information obtained in the step S102 is accommodated and is determined on the basis of the recording material information for the cassette obtained in the step S103.

S108 represents a step for obtaining information on a transparent image data amount designated by the user. The transparent image data amount refers to the data amount of the transparent toner image which is desired to be synthesized by the user on the basis of the output product outputted in the step S107. The transparent image data amount is, as described above, selected by the transparent image selecting portion 154. The CPU 101 stores the obtained transparent image data information in the RAM 102.

In a step S109, the transparent image data obtained in the steps S104 and S107 are sent to the printer portion, so that the transparent toner images are formed and fixed on the original and then the original is outputted.

Incidentally, e.g., before the step S105, preference or desire of the user may also be inputted before the transparent image data of the four patterns are obtained. For example, when the user desires the output product with the high glossiness in advance, the user's desire is inputted so that the pattern close to that for the output product can be outputted. Alternatively, with respect to the first region (pattern), in the case where the user's desire is, e.g., a check pattern, the user's desire is inputted, so that a plurality of check patterns may also be displayed.

Thus, the test print formed with the transparent toner can be automatically outputted, so that it becomes possible to designate a desired transparent toner amount after viewing an actual output product. Therefore, it is possible to quickly obtain the resultant product with an expected effect of the transparent toner.

[Operation of MFP Depending on Input by User]

As described above, in the operation in the test mode, the test print (sample image) is outputted on the basis of the image data designated by the user. Then, the transparent image is synthesized on the original by using the transparent image data selected from the test print.

For this purpose, the MFP 100 obtained "information on region in which transparent image is intended to be synthesized by user" and "information on data for which transparent toner image is intended to be synthesized by user". The procedure for inputting the "information on region in which transparent image is intended to be synthesized by user" and the "information on data for which transparent toner image is intended to be synthesized by user" into the MFP 100 is described below.

Hereinafter, the "information on region in which transparent image is intended to be synthesized by user" and the "information on data for which transparent toner image is intended to be synthesized user" are referred to as transparent print setting information (information required to be set for outputting the transparent image).

The MFP 100 displays the screens shown in FIG. 5 to FIG. 11 at the display 111 in order to obtain the transparent print setting information. A transition among the respective screens will be summarized.

[Setting Status when MFP 100 Synthesizes and Output Transparent Image]

Figure 5:
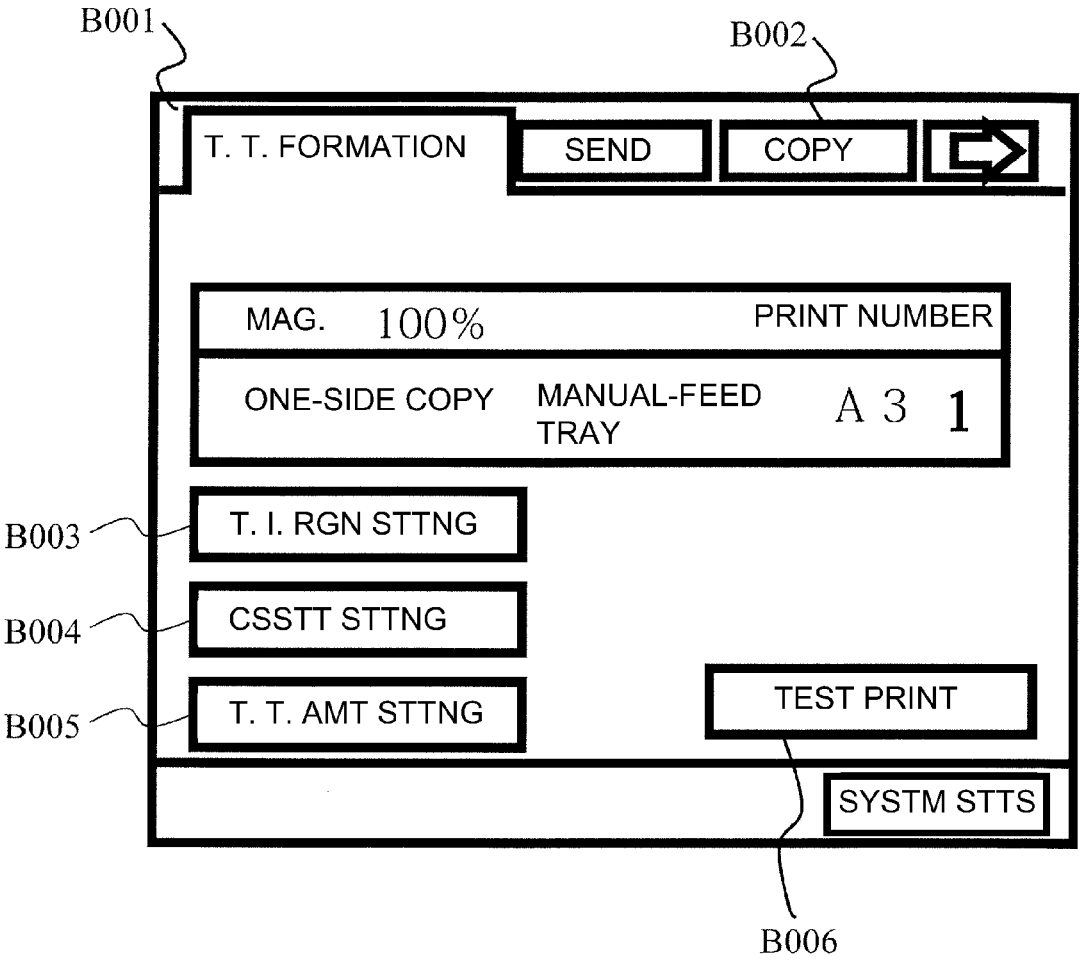

FIG. 5 is a schematic view showing an example of the screen showing a setting status when the MFP 100 synthesizes and outputs the transparent image. In a state in which the screen shown in FIG. 5 is displayed at the display 111 (in a transparent image synthesizing mode), when a start button (not shown) in the operating panel 112 is pushed down by the user, the MFP 100 synthesizes the transparent image on the recording material set on the manual-feeding tray. An image forming region in which the transparent image is synthesized in this case is a region designated by the screen of FIG. 6 displayed by pushing down B003 through the operating panel 112.

Further, the toner amount per unit area of the transparent image is the toner amount corresponding to the transparent image data amount designated by a screen (not shown) displayed by pushing down B005 through the operating panel 112. Incidentally, when B002 is selected through the operating panel 112, the mode of the MFP 100 is switched to a box mode. In the box mode, the user can output the data, stored in the HDD inside the MFP 100, at the printer portion. When the user selects B001, the mode of the MFP 100 is switched from the box mode to the transparent image synthesized mode. Incidentally, by pushing down B004, initial setting of the information on the recording material accommodated in the cassette or the deck can be made.

In FIG. 5, the user can select B006 for "TEST PRINT". When the user selects B006 ("TEST PRINT"), the MFP 100 displays the screen shown in FIG. 8 at the display 111.

[Input of Information on Region in which Transparent Image is Intended to be Formed (Synthesized) by User]

Figure 6:
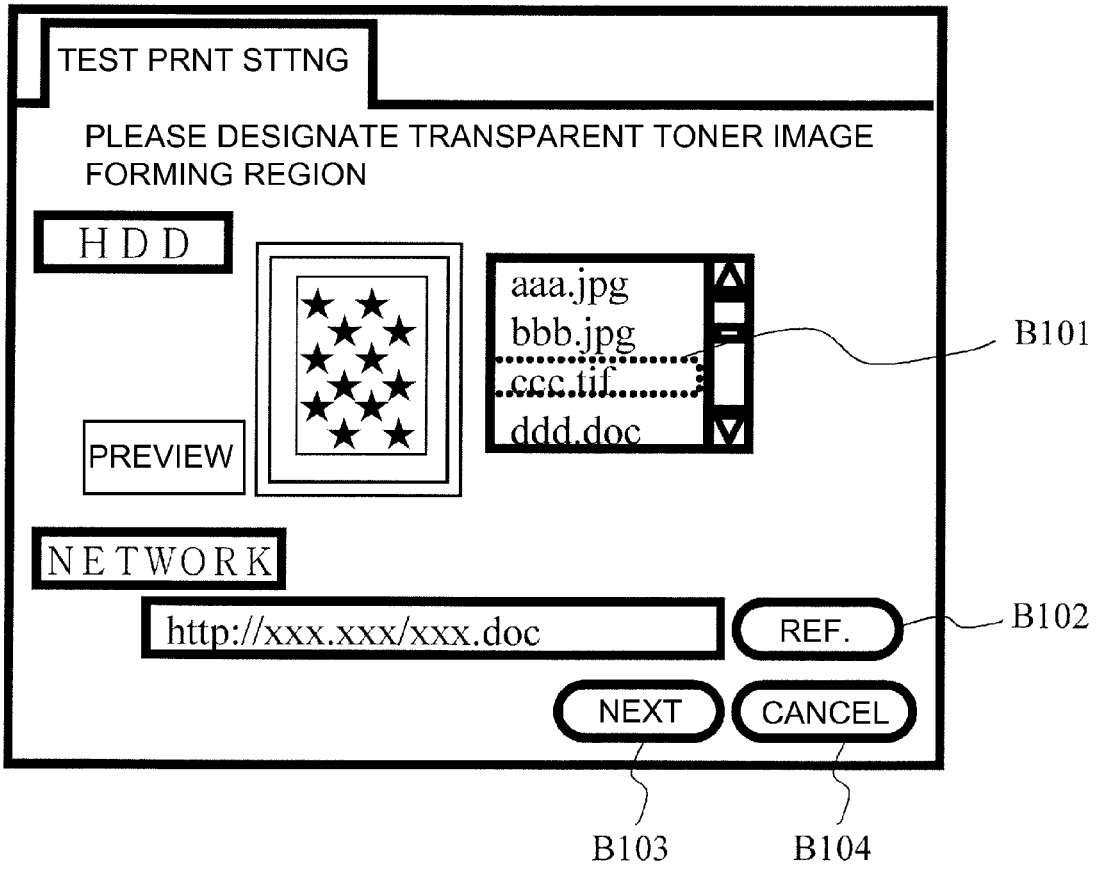

FIG. 6 is a schematic view showing the example of the screen for urging the user to input the "information on region in which transparent image is intended to be formed by user" by the MFP 100. In FIG. 6, files stored in the HDD 104 inside the MFP 100 are displayed in a selectable manner in list form. As a result, the user can designate (select) the file, indicating the region in which the transparent image is intended to formed, from the files stored in the HDD 104. That is, this screen corresponds to the above-described image region selecting portion 155. In this example, it is assumed that a file "ccc.tif" is designated with a cursor B301 by the user. In this way, the region in which the user wishes to form the transparent image can be designated by the image (file). Here, the file "ccc.tif" is a file for the image as shown at a preview display portion shown in FIG. 6. In the image shown at the preview display portion, a marked portion (asterisk () portion) refers to the region in which the user wishes to form the transparent image. Incidentally, the area in which the user wishes to form the transparent image by using another means other than the file stored in the HDD 104 may also be designated. For example, a method in which an external file is designated through the I/F 114 may also be employed. The user can designate the file other than the file stored in the HDD 104 by selecting a button B102**. Incidentally, the area designating method is not limited thereto.

In this specific example, as shown in FIG. 6, the designation of the area in which the transparent image is intended to be formed is made by the file "ccc.tif" stored inside the HDD 104. In the case where the user wishes to reflect the above-described settings, the user can select B103. As a result, the settings are reflected, and then the MFP 100 displays the screen shown in FIG. 7 at the display 111. The information set by the user in this way is stored in the RAM 102. The thus-stored information, for designating the region in which the transparent image is intended to be formed, in the RAM 102 is obtained by the CPU 101 in the step S104. Further, in the case where the user does not wish to reflect the settings, the user can select B104 ("CANCEL" button). As a result, the settings are canceled and the MFP 100 displays the screen shown in FIG. 5 on the display 111.

[Input of Information on the Type of Recording Material of Original]

Figure 7:
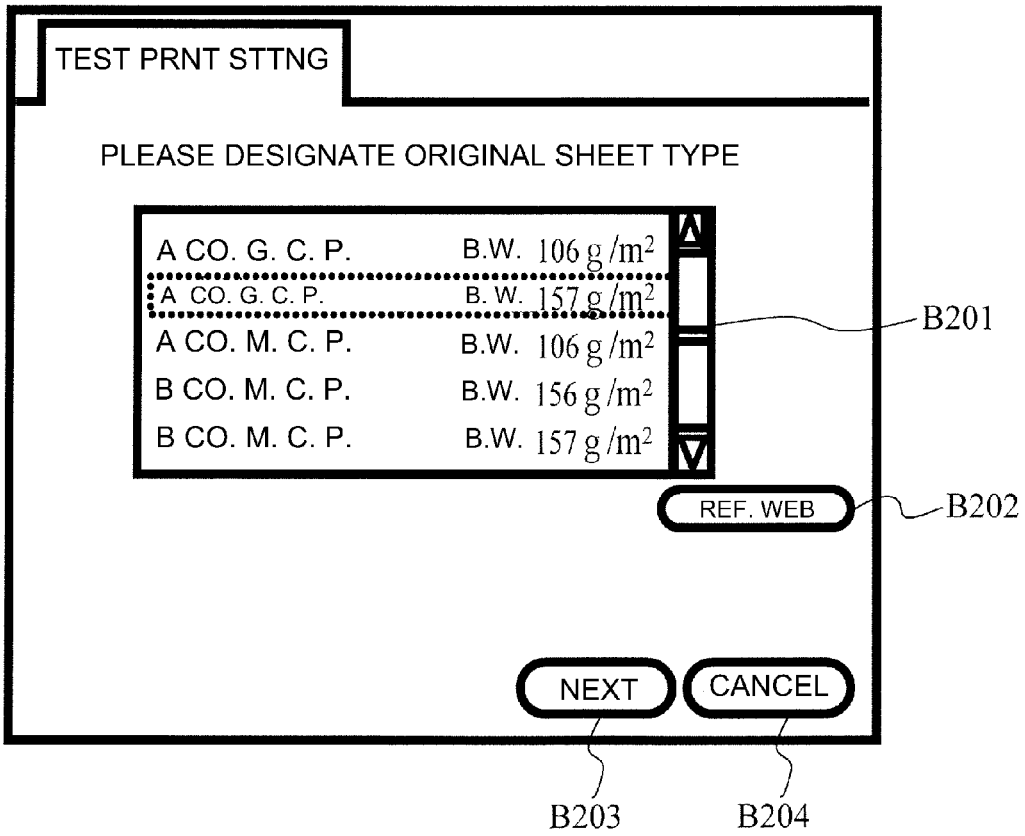

FIG. 7 is a schematic view showing an example of a screen in which the MFP 100 urges the user to input "information on type of recording material of original". The user can change the information on the recording material of the original with a cursor B201. In this case, on the display 111, the types of the recording material which can be selected by the user is presented in list form. In this embodiment, the original recording material is "A CO. G.C.P.B.W. 157 g/m$^2$" and the user can select "A CO. G.C.P.B.W. 156 g/m$^2$" by using B201. That is, the screen corresponds to the above-described recording material information obtaining portion 156. Incidentally, in the case where the recording material type is not displayed in the list, the user can select B202. When B202 is selected, the MFP 100 may be connected to a server via the network to designate another paper (recording material) type. Incidentally, the recording material type designating method is not limited thereto. In the case where the user wishes to reflect the above-described settings, the user can select B203 ("NEXT" button). As a result, the settings are reflected, and then the MFP 100 displays the screen shown in FIG. 8 at the display 111. The information set by the user in this way is stored in the RAM 102. The thus-stored information, on the recording material on which the transparent image is synthesized (formed), in the RAM 102 is obtained by the CPU 101 in the step S102. Further, in the case where the user does not wish to reflect the settings, the user can select B204 ("CANCEL" button). As a result, the settings are canceled and the MFP 100 displays the screen shown in FIG. 6 on the display 111.

[Obtaining of Information on Color Image Data of Original on which Transparent Image is Intended to be Synthesized]

Figure 8:
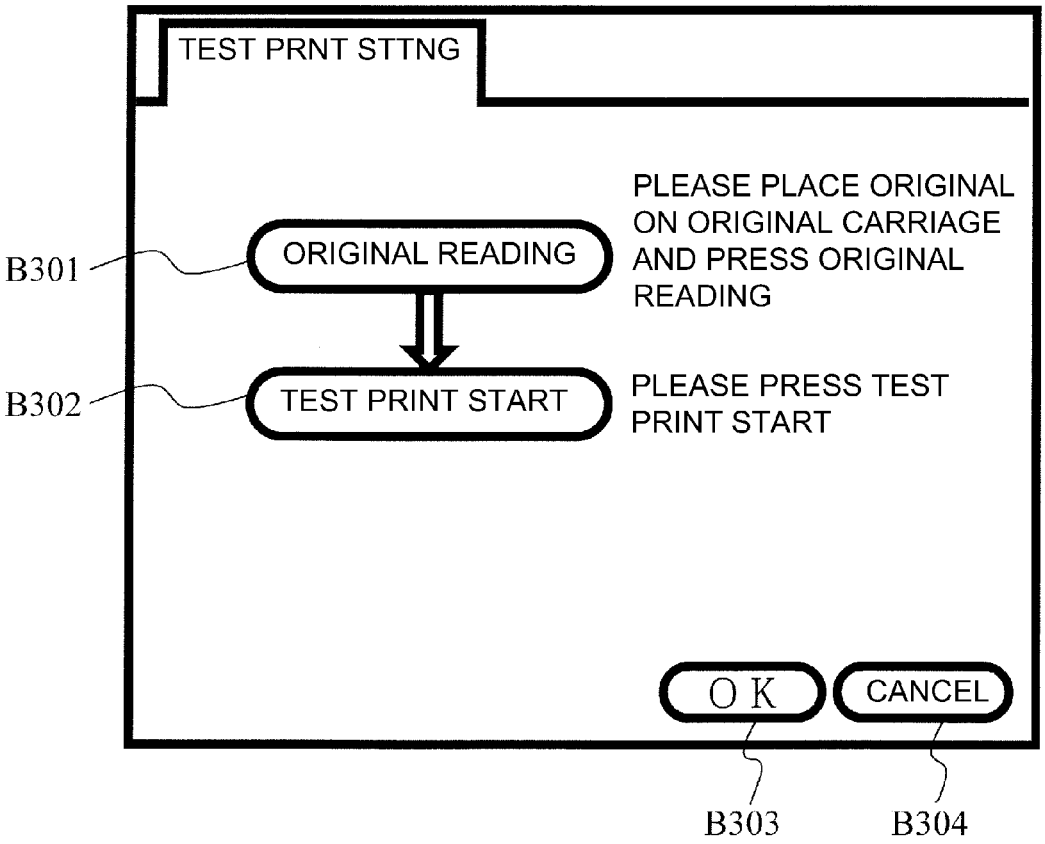

FIG. 8 is a schematic view showing an example of a screen in which the MFP 100 urges the user to place, on the original carriage, the original on which the transparent toner image is intended to be synthesized. The user places, on the original carriage, the original on which the transparent image is intended to be synthesized and thereafter the user selects B301 ("ORIGINAL READING" button). As a result, the scanner portion 116 optically scans the original to read the color image of the original by color separation, so that color image data for which the user wishes to synthesize the transparent image can be set. That is, the screen (scanner portion 116) corresponds to the above-described color data obtaining portion 152. Thus, the color image data stored in the RAM 102 is obtained by the CPU 101 in the step S101.

After B301 is selected to set the color image data of the original, the user can start the test print by selecting B302

("TEST PRINT START" button). As a result, the processing of S103 to S106 is executed by the CPU 101, so that synthetic sample data is outputted in 4-in-1 manner. In this embodiment, transparent toner image data amounts of 4 patterns of 50%, 75%, 90% and 100% are generated in the step S105. Therefore, the synthetic sample images of 4 patterns are outputted on a single (one) sheet of the recording material. Incidentally, the number and type of the patterns are not limited to those described above. For example, 6 patterns of 10%, 20%, 40%, 60%, 80% and 100% may also be used. Further, the user can select the patterns to be outputted.

Incidentally, in this embodiment, the operation of the main assembly when the test prints outputted is automatic internal multi-fixation such that first fixation is effected by using only the color toners and thereafter second fixation is effected by using the transparent toner.

Figure 9:
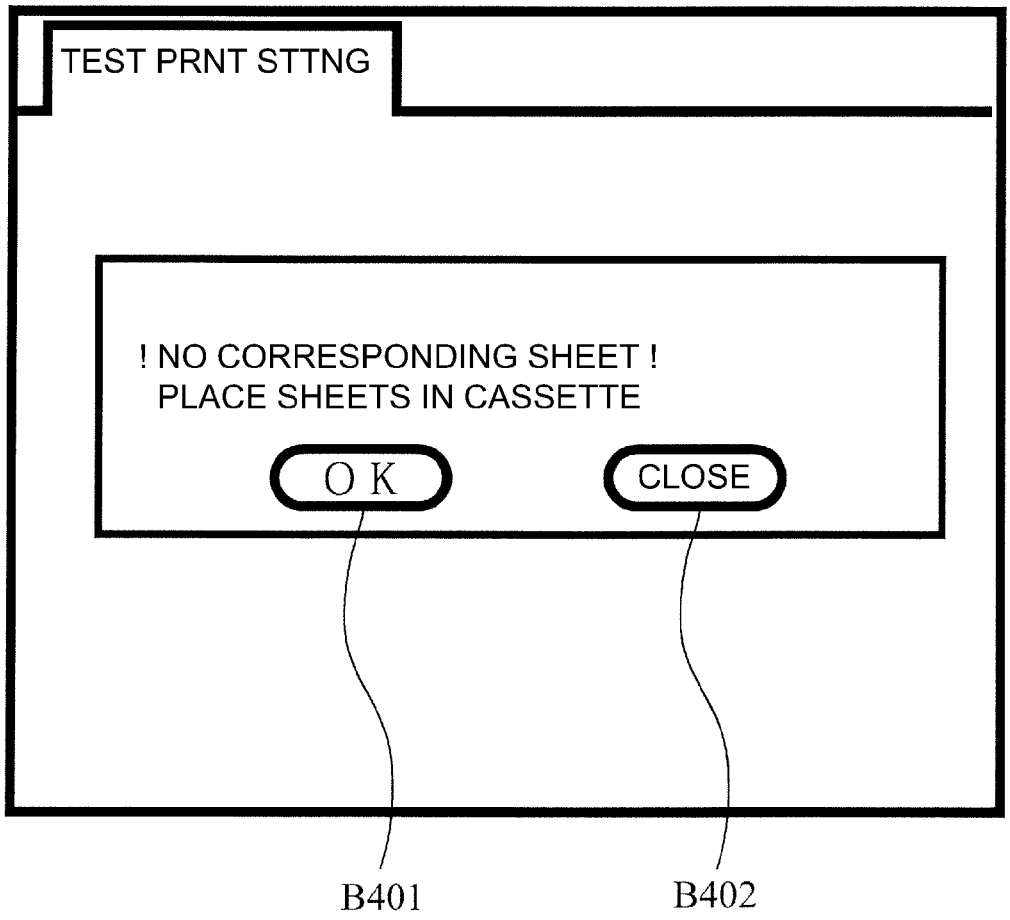

In the step S103, the CPU 101 refers to the information on each sheet feeding cassette and feeds the sheet from the sheet feeding cassette in which the recording material corresponding to the type of the original recording material obtained in the step S102 is set, thus outputting the test print. In the case where the recording material which is the same as the original is set in the cassette 80 in advance, the CPU 101 feeds the sheet from the cassette 80 and then outputs the test print. That is, the CPU 101 corresponds to the above-described accommodating portion selecting portion 157. On the other hand, in the case where the recording material corresponding to the recording material type obtained in the step S102 is not set in the sheet feeding cassette, a warning message as shown in FIG. 9 is displayed on the display 111. In this case, by selecting a cursor (button) B401, the user can newly set the recording material in the sheet feeding cassette. Alternatively, by selecting a cursor (button) B402, setting can be made so that the sheet is fed from any of the sheet feeding cassettes even when the type of the recording material does not coincide with the recording material set in the sheet feeding cassette.

In the case where the user checks the output product and wishes to go to a next step for selecting the transparent image data, the user can select B303 ("OK" button) in FIG. 8. As a result, the operation can go to the next step for selecting the transparent image data, so that the MFP 100 displays a screen shown in FIG. 10 on the display 111. Further, in the case where the user does not wish to reflect the settings, the user can select B304 ("CANCEL" button). As a result, the settings are canceled, and then the MFP 100 displays the screen shown in FIG. 9 at the display 111.

[Setting of Information on Data of Transparent Image Intended to be Synthesized]

Figure 10:
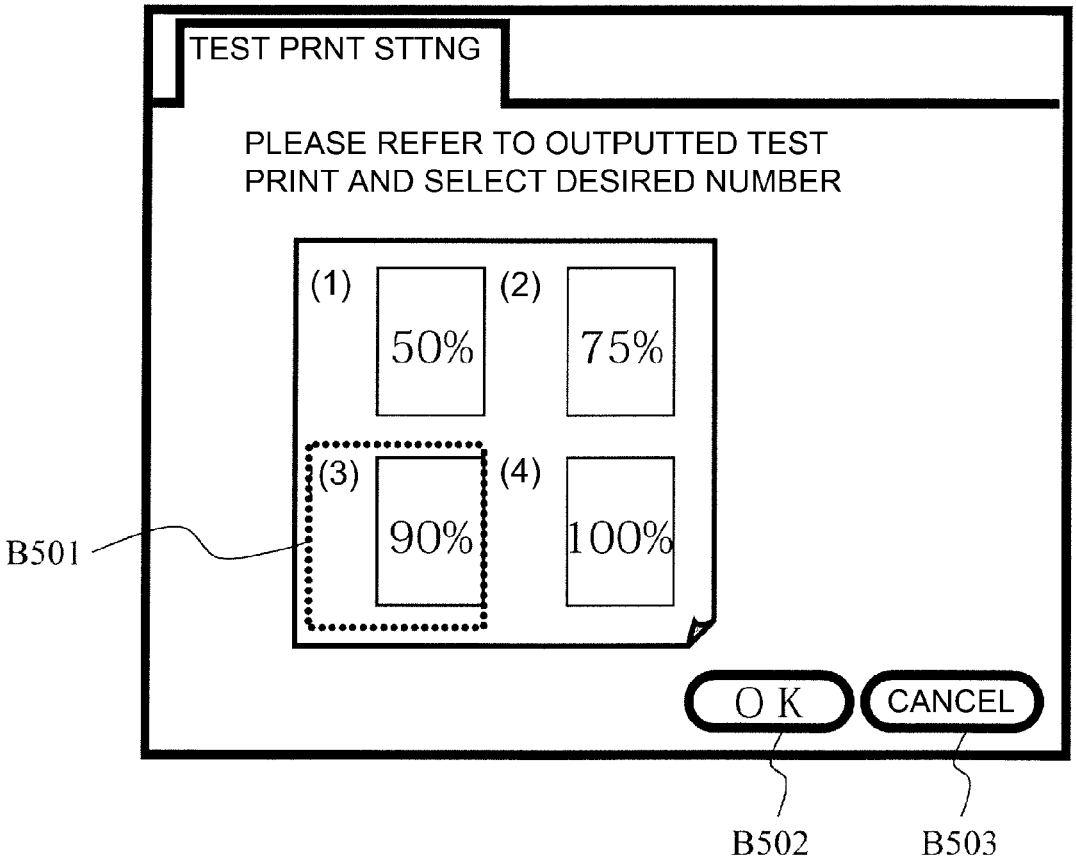

FIG. 10 is a schematic view showing an example of a screen in which the MFP 100 urges the user to designate the transparent image data intended to be subjected to synthesization by the user. The user refers to the synthetic sample image outputted in the step S107 and thus can select a desired transparent toner image data amount corresponding to a sample number by using a cursor B501. That is, the screen (cursor B501) corresponds to the above-described transparent image selecting portion 154. In this embodiment, the user selects "(3) 90%" with the cursor B501. Incidentally, the method of designating the transparent image data intended to be subjected to synthesization is not limited to the above method.

In the case where the user wishes to reflect the above-described setting, the user can select B502 ("OK" button). As a result, the setting is reflected and the MFP 100 displays a screen shown in FIG. 11 on the display 11. The information set by the user as described above is stored in the RAM 102. The information on the transparent image data stored in the RAM 102 in this way is obtained by the CPU 101 in the step S108. Further, in the case where the user does not wish to reflect the setting, the user can select B503 ("CANCEL" button). As a result, the setting is canceled, so that the MFP 100 displays the screen shown in FIG. 5 on the display 111.

[Setting of Information on Sheet Feeding Cassette for Original on which Transparent Image is to be Synthesized]

Figure 11:
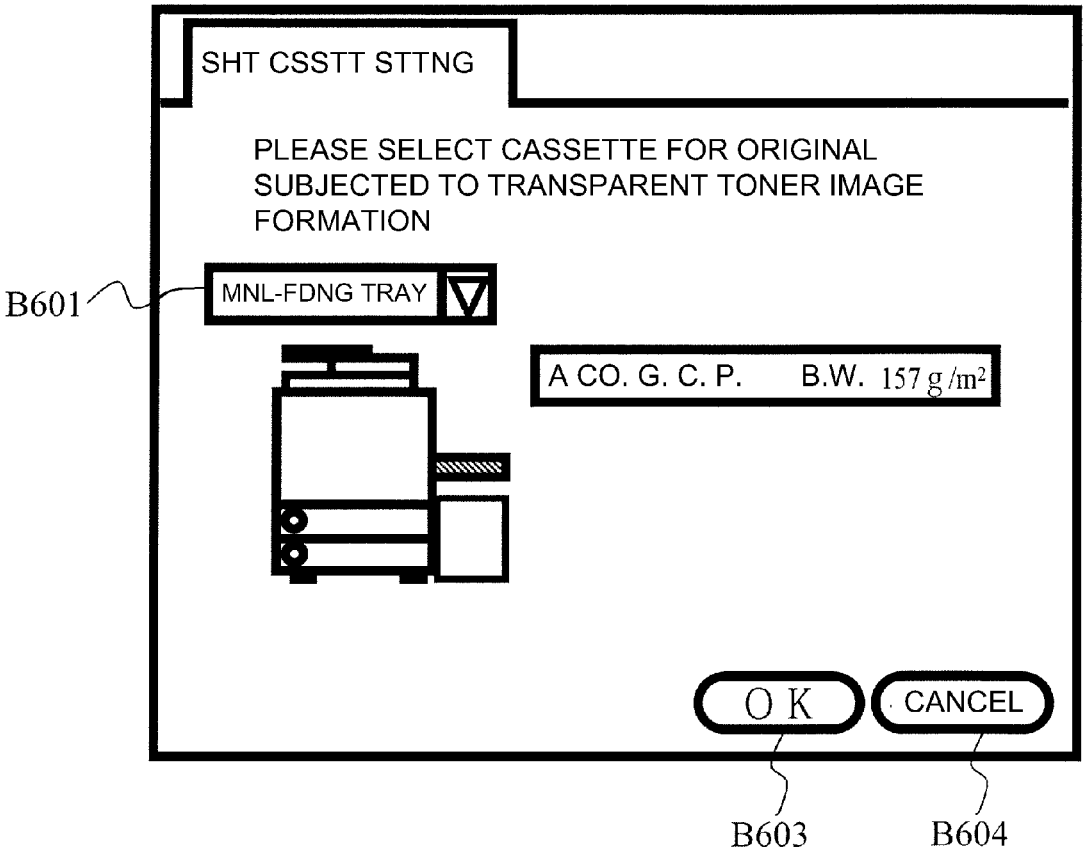

FIG. 11 is a schematic view showing an example of a screen in which the MFP 100 urges the user to designate the sheet feeding cassette for the original on which the transparent image is to be synthesized. The user designates, on the basis of the transparent image data designated in the steps S103 and S107, the sheet feeding cassette for the original on which the transparent image is to be synthesized, by using a cursor B601. The user can select the cassette 80, the deck 60 or the manual-feeding tray 2 shown in FIG. 2, in which the recording material used for printing is set. When the user selects B601, "CASSETTE", "DECK" and "MANUAL-FEEDING TRAY" are selectably presented on the display 111 as a pull-down menu. In this embodiment, the user selects the "MANUAL-FEEDING TRAY" by B601.

In the case where the user wishes to reflect the above-described setting, the user can select B603 ("OK" button). As a result, the setting is reflected. In this state, when a start button (not shown) is pushed down by the user, the MFP 100 synthesizes the transparent image on the original set in the manual-feeding tray. Further, in the case where the user does not wish to reflect the setting, the user can select B604 ("CANCEL" button). As a result, the setting is canceled, so that the MFP 100 displays the screen shown in FIG. 10 on the display 111.

[MFP Operation Based on Test Print Setting Information]

In a state in which the test print setting information is reflected, when the start button (not shown) is pushed down, the MFP 100 performs the following operation on the basis of the test print setting information.

Parts (a) to (f) of FIG. 12 are schematic views for illustrating an image to be processed by and an output product to be outputted by the MFP 100. With reference to (a) to (f) of FIG. 12, processing performed in respective steps shown in the flow chart of FIG. 4 will be described.

In the step S101, the CPU 101 obtains the information on the color image data for the original stored in the RAM 102 as described above. This color image data for the original corresponds to that shown in (b) of FIG. 12 designated by the "ORIGINAL READING" button of "TEST PRINT SETTING".

In the step S102, the CPU 101 obtains the recording material information, designated by the user, stored in the RAM 102. In the step S103, the CPU 101 obtains the recording material information, for the sheet feeding cassette, stored in the RAM 102.

In the step S104, the CPU 101 obtains the information on the region, in which the transparent image designated by the user is intended to be formed, stored in the RAM 102. This region corresponds to the transparent image forming region "ccc.tif" designated by the "TEST PRINT SETTING" and is shown in (a) of FIG. 12.

In this embodiment, the image data (file) "ccc.tif" for designating the region in which the user wishes to form the transparent image is stored in the HDD 104. Incidentally, in the case where the image data for designating the region in which the user wishes to form the transparent image is not the image data such as "tif" file but is described by the PDL, the file described by the PDL is subjected to the RIP by the CPU 101 and the dedicated image processing circuit 106. As a result, the CPU 101 can prepare the transparent image data for selectively forming the transparent toner image in the region described by the PDL.

In the step S105, the CPU 101 generates the transparent image data, different in data amount with respect to the image region obtained in the step S104, in a plurality of patterns (N patterns). This transparent image data corresponds to the transparent image data of 4 patterns shown in (c) of FIG. 12.

In the step S106, the CPU 101 synthesizes the transparent image data ((a) of FIG. 12) of the 4 patterns generated in the step S105 on the color image data ((b) of FIG. 12) obtained in the step S101, thus preparing sample image data which can be outputted in 4-in-1 manner. These sample image data are shown in (d) of FIG. 12.

The CPU 101 sends the transparent image data ((d) of FIG. 12) prepared in the step S106 to the printer controller 108.

Further, the CPU 101 sends the recording material information obtained in the step S102 to the printer controller 108.

The printer controller 108 controls the printer portion 115 on the basis of the received transparent image data ((d) of FIG. 12). As a result, the printer portion 115 outputs the transparent image and the color image on the recording material set in the sheet feeding cassette. Thus, a print shown in (e) of FIG. 12 is outputted.

In the step S108, the CPU 101 obtains the information on the transparent image data amount, designated by the user, stored in the RAM 102. The CPU 101 sends the image data designated in the steps S104 and S108 to the printer controller 108. As a result, the printer portion 115 outputs the transparent image on the original set in the sheet feeding cassette. In this embodiment, the "(3) 90%" is designated as the transparent image data amount to be outputted and therefore the image data of the "(3) 90%" is outputted on the original.

As described above, in this embodiment, the test mode in which the test print of the 4 patterns different in transparent toner amount (plurality of synthetic images) is automatically outputted on the single sheet of the recording material is provided. For this reason, it is possible to quickly obtain a print (output product) with an expected effect of the transparent toner. Further, it becomes possible to prevent a defective print, so that an operation efficiency can be enhanced.

Further, in this embodiment, the test print is outputted on the single sheet or on the recording material sheets which are smaller in number than the transparent image data and therefore waste of the recording material can be suppressed. Further, as the recording material on which the sample image is to be formed, the recording material which is the same as or close in material to the recording material on which the color image is formed is used and therefore the output product in the operation in the test mode is the same as or close to an actual output product. Accordingly, the number of defective prints by the user can be further reduced.

<Second Embodiment>

Second Embodiment of the present invention will be described with reference to FIG. 13 to FIG. 18.

Incidentally, portions or means similar to those in First Embodiment are represented by the same reference numerals or symbols, thus being omitted from description. In this embodiment, the image forming system (image forming apparatus) is constituted as shown in (b) of FIG. 1 described above. Further, the image processing for generating the transparent image data is executed by the MFP controller 200.

Hardware configurations of the PC 300 and the MFP controller 200 which constitutes the image forming system will be described.

The PC 300 constituting the image forming system is an example of an external terminal capable of sending print instructions to the MFP 100. For that purpose, it is also possible to use other terminals capable of sending the print instructions to the MFP 100 as an alternative to the PC. For example, it is possible to use portable information terminals such as a WS (work station) and a PDA (personal digital assistant) as the alternative to the PC.

[Hardware Configuration of PC]

FIG. 14 is a block diagram showing the hardware configuration of the PC 300 as an example of the PC. The hardware configuration of the PC 300 will be described.

A CPU 301, an RAM 302, and an ROM 303 are connected to a bus 304. Similarly, a HDD 305, a network controller 306, a video controller 307, and an I/O controller 308 are connected to the bus 304. The various units connected to the bus 304 are communicatable with each other through the bus 304. The CPU 301 executes a program, e.g., stored in the ROM 303 by expanding the program in the RAM 302. The ROM 303 stores the program executed by the CPU 301. The RAM 302 is used when the CPU 301 executes the program. Further, the CPU 301 sends control instructions and the like to the HDD 305, the network controller 306, the video controller 307, and the I/O controller 308 through the bus 304. Further, the CPU 301 receives signals for indicating states or data such as image data from the HDD 305, the network controller 306, the video controller 307, and the I/O controller 308 through the bus 304. Thus, the CPU 301 is capable of controlling the various units constituting the PC 300.

The HDD 305 stores various files used in the PC 300. The network controller 306 is a dedicated circuit for communicating with external equipment. The network controller 306 modifies and converts the signals sent from the CPU 301 into multi-valued signals in accordance with the IEEE 803.2 standard and sends the signals to the network through an I/F 312. Further, the network controller 306 demodulates the multi-valued signals received from the network through the I/F 312 and sends the demodulated signals to the CPU 301. In this case, a communication path through which the PC 300 communicates with the MFP 100 or the MFP controller 200 is not limited to that in a LAN (local area network) but may also be that through the Internet.

Further, the I/O controller 308 converts the signals sent from the CPU 301 into signals in accordance with standards for the respective interfaces and sends the converted signals to a device connected with an USB I/F 313 or a PS (personal system)/2 I/F 309. Conversely, the I/O controller 308 converts the signals received from the USB I/F 313 or the PS/2 I/F 309 and sends the converted signals to the CPU 301. As a result, the PC 300 and the MFP 100 can communicate with each other through the USB I/F 313. Further, the PC 300 obtains an input signal from a keyboard 310 and a mouse 311 as an input device through the PS/2 I/F 309.

The video controller 307 converts the image data into a signal for a screen displayable at a display 314 in accordance with image display instructions received from the CPU 301. As a result, the CPU 301 can display the screen at the display 314.

In this embodiment, the CPU 301 controls various pieces of hardware constituting the PC in accordance with an OS (operating system). As a result, the user can cause the PC to execute a desired operation by manipulating a GUI (graphical user interface) without concern for the hardware constituting the PC. Further, the user is capable of sending the print instructions from an application program, which is running under the OS, to the external MFP. When the print instructions are sent to the MFP, a control method varies depending on the kind of the MFP. For that reason, the PC produces control instructions depending on the MFP by using a driver program corresponding to the kind of the MFP. The driver program is capable of producing the control instructions depending on the connected peripheral equipment by being incorporated in the OS.

[Hardware Configuration of MFP Controller]

FIG. 13 is a block diagram showing the hardware configuration of the MFP controller 200 capable of converting the PDL into the image data. An example of the hardware configuration of the MFP controller 200 will be described.

The MFP controller 200 constituting the image forming system converts the PDL received from the PC 300 into the image data used for the printing by the MFP 100. The processing for converting the PDL into the image data is referred to as the RIP.

A CPU 201, an RAM 202, and an ROM 203, and a dedicated image processing circuit are connected to a bus 205. Similarly, a HDD 204, a network controller 207, a video controller 208, and an I/O controller 209 are connected to the bus 205. The CPU 201 executes a program, e.g., stored in the ROM 203 by expanding the program in the RAM 202. Further, the CPU 201 sends control instructions and the like to the HDD 204, the network controller 207, the video controller 208, and the I/O controller 209 through the bus 205. Further, the CPU 201 receives signals for indicating states and data such as image data from the HDD 204, the network controller 207, the video controller 208, and the I/O controller 209 through the bus 205. Thus, the CPU 201 is capable of controlling the various units constituting the MFP controller 200.

MFP controller 200 is connected with the PC 300 through an I/F 213. The MFP controller 200 is connected with the MFP 100 through the I/F 213. The network controller 207 modifies and converts the signals sent from the CPU 201 into multi-valued signals in accordance with the IEEE 803.2 standard and sends the signals to the network through the I/F 213. Further, the network controller 207 demodulates the multi-valued signals received from the network through the I/F 213 and sends the demodulated signals to the CPU 201.

Further, the I/O controller 209 converts the signals sent from the CPU 201 into signals in accordance with standards for the respective interfaces and sends the converted signals to a device connected with an USB I/F 214 or a PS (personal system)/2 I/F 210. Further, the I/O controller 209 converts the signals received from the USB I/F 214 or the PS/2 I/F 210 and sends the converted signals to the CPU 201. As a result, the MFP controller 200 and the MFP 100 can communicate with each other through the USB I/F 214. Further, the MFP controller 200 obtains an input signal from a keyboard 211 and a mouse 212 as an input device through the PS/2 I/F 210.

The video controller 208 converts the image data into a signal for a screen displayable at a display 215 in accordance with image display instructions received from the CPU 201 and sends the converted signal to the display 215. As a result, the CPU 201 can display the screen at the display 215.

The MFP controller 200 receives the PDL sent from the PC 300 and subjects the described PDL to the RIP. Arithmetical operation instructions during the RIP includes uniform iteration process. For that reason, in many cases, a shorter execution time is required for processing by a hardware optimized for processing image processing instructions rather than execution of all the arithmetical operation instructions by the CPU 201. For that reason, the MFP controller executes the RIP by sharing the processing between the CPU 201 and the dedicated image processing circuit 206. The RIP may also be performed by the CPU 201 alone. The dedicated image processing circuit 206 is constituted by an ASIC (application specific integrated circuit). The dedicated image processing circuit 206 may also be constituted by mounting a reconfigurable hardware (e.g., a PLD (programmable logic device)). The thus-converted image data by the CPU 201 and the dedicated image processing circuit 206 is sent to the MFP 100.

In this embodiment, preparation of the image data is carried out by the MFP controller 200 but may also be carried out by the MFP 100.

The explanation on the hardware configuration of the MFP controller in this embodiment is as described above.

[MFP Controller Operation Along Flow Chart]

In this embodiment, the image forming system is constituted by the PC 300, the MFP controller 200, and the MFP 100 as shown in (b) FIG. 1. The PC 300, the MFP controller 200, and the MFP 100 operate in accordance with the programs stored in the ROM 303, the ROM 203, and the ROM 103, respectively. The image processing operation performed by the MFP controller 200 as the information processing apparatus in accordance with the program stored in the ROM 203 will be described below. Here, the description will be made with a view to explain how the information processing apparatus operates in accordance with the program, so that a detailed operation of the entire image forming system for the image formation will be described later.

In this embodiment, the image processing which is a characteristic processing is performed by a CPU 201 of the MFP controller 200. FIG. 15 is a flow chart for illustrating the image processing procedure in this embodiment. Along the flow chart shown in FIG. 15, a flow of execution of the image processing by the CPU 201 will be described.

S201 represents a step of obtaining information indicating a "color image data for which transparent images are intended to be synthesized" designated by the user. A CPU 201 as the control means obtains the information on the color image data for which transparent images are intended to be synthesized by the user by the color image data obtaining portion 152 ((b) of FIG. 3) as a color image data information obtaining means.

S202 represents a step for obtaining information on the recording material. The CPU 201 obtains the information on the recording material, on which the transparent images are synthesized, by the recording material information obtaining portion 156 ((b) of FIG. 3). Here, the obtained recording material information refers to the type of the recording material.

S303 represents a step for obtaining information on the sheet feeding cassette. The CPU 201 obtains, as a cassette information obtaining means, the information on each of the recording materials applied in the sheet feeding cassettes (such as the cassette 80 and the deck 60 (FIG. 2)). Here, the obtained recording material information refers to the type of the recording material.

S204 represents a step for obtaining N patterns of information indicating "transparent image data intended to be synthesized" designated by the user. The CPU 201 obtains the N patterns of the information indicating the transparent image data, which is desired to be synthesized by the user, by the transparent data obtaining portion 153 ((b) of FIG. 3) as a transparent image data information obtaining means.

In a step S205, the CPU 201 executes, as an image data generating means, generating processing of synthetic sample image data. The synthetic sample image data refers to sample image data, for being outputted in N-in-1 manner, obtained by synthesizing the transparent image data of the N patterns obtained in the step S204 on the color image data obtained in the step S101.

In a step S206, the sample image data generated in the step S205 are set to the printer portion, so that the recording material on which the transparent image and the color image are formed and fixed (the recording material on which the sample image is formed) on the basis of the synthetic sample image data is outputted. The sheet feeding cassette for this recording material is the sheet feeding cassette in which the recording material corresponding to the recording material information obtained in the step S202 is accommodated and is determined on the basis of the recording material information for the cassette obtained in the step S203.

S207 represents a step for obtaining information on a transparent image data amount designated by the user. The transparent image data refers to the data of the transparent toner image which is desired to be synthesized by the user on the basis of the output product outputted in the step S206. That is, the user views the plurality of synthetic images (sample images) and then selects a desired image by the transparent image selecting portion 154.

In a step S208, the transparent image data obtained in the step S207 is sent to the printer portion, so that the transparent toner images are formed and fixed on the original and then the original is outputted.

Thus, the test print formed with the transparent toner can be automatically outputted, so that it becomes possible to designate a desired transparent image data after viewing an actual output product. Therefore, it is possible to quickly obtain the resultant product with an expected effect of the transparent toner.

In this embodiment, the steps from S201 to S208 are performed by the MFP controller 200. However, the steps from S201 to S208 may also be performed by different CPUs inside a plurality of devices constituting the image forming system. That is, e.g., the processing in the step S201 may be performed by the CPU 201 inside the MFP controller 200 and the processing in the step S202 may be performed by the CPU 101 inside the MFP 100.

The above is the description as to the image processing which is the characteristic processing in the MFP controller 200.

[Transparent Image Data Obtaining Operation]

In this embodiment, the transparent image data indicating the transparent image forming region and the transparent image data amount (the PDL in this embodiment) is sent from the PC 300 to the MFP controller 200. Incidentally, the transparent image data indicating the transparent image forming region and the transparent image data amount may only be required to be designated by the PC 300 and is not required to be stored in the HDD 305 inside the PC 300. An example for designating the transparent image data indicating the transparent image forming region and the transparent image data amount will be described below.

FIG. 16 is a schematic view showing an example of a screen for urging the user to input the "information on transparent image data". As shown in FIG. 16, files stored in an HDD 305 inside the PC 300 are displayed on a display 314 in a selectable manner in list form. As a result, the user can designate (select) the file, indicating the transparent image data from the files stored in the HDD 305 by using a mouse 311 or the like. That is, the screen corresponds to the image region selecting portion 155 shown in (b) of FIG. 3. In FIG. 16, by selecting B702, it is possible to designate "fff.tif" as a file for the transparent image data. The designated file is, as shown in B701, selected as a third transparent image data for the test print. In FIG. 16, as the file indicating the transparent image data, four types of files "ddd.tif", "eee.tif", "fff.tif" and "ggg.tif" are selected. Further, the user can also designate a file other than the files stored in the HDD 305.

Incidentally, the method of designating the transparent image forming region and the transparent image data amount is not limited to the designation by the file. For example, the designation may also be made by a repeated image pattern of symbols such as a note mark, a circle mark, a triangle mark and an asterisk preset in the PC 300. Further, not only the image region but also the toner amount per unit area may also be changed. For example, in each of 4 patterns of the image regions, data with 4 patterns of the toner amounts per unit area are provided, so that 16 patterns of the transparent image data may also be obtained. In this case, 16 patterns of the sample images may be formed on a single sheet of the recording material or on 4 sheets, each on which 4 patterns of the sample images are formed, of the recording material.

In the case where the user wishes to reflect the above-described setting, the user can select B703 ("OK" button), so that the above setting is sent to the MFP controller and then the designated 4 types of image data for the transparent toner are generated. That is, the transparent data obtaining portion 153 obtains the plurality of types (4 types) of the transparent image data. Further, in the case where the user do not wish to reflect the settings, the user can select a button B704 ("CANCEL" button). As a result, the user can designate the plurality of the transparent image data by using the PC 300.

[Setting of Information on Data of Transparent Image Intended to be Synthesized]

FIG. 17 is a schematic view showing an example of a screen in which the MFP 100 urges the user to designate the transparent image data intended to be subjected to synthesization by the user. The user refers to the synthetic sample image outputted in the step S206 and thus can select a desired transparent toner image data amount corresponding to a sample number by using the mouse 311 or the like. That is, the screen (the mouse 311) corresponds to the above-described transparent image selecting portion 154 shown in (b) of FIG. 3. In this embodiment, the user selects "(3) fff.tif" at B801. Incidentally, the method of designating the transparent toner image data intended to be subjected to synthesization is not limited to the above method.

In the case where the user wishes to reflect the above-described setting, the user can select B802 ("OK" button), so that the setting described above is sent to the MFP controller. Further, in the case where the user does not wish to reflect the setting, the user can select B803 ("CANCEL" button).

[Operation of Image Forming System Based on Test Print Setting Information]

An operation of the image forming system will be described below. As described above, the "transparent image data" of the test print setting information is designated by the PC 300. The user causes the PC 300 to send the print command to the MFP controller 200. In this embodiment, as the transparent image data, the 4 types of data "ddd.tif", "eee.tif", "fff.tif" and "ggg.tif" are designated.

Parts (a) to (f) of FIG. 18 are schematic views for illustrating an image to be processed by and a print to be outputted by the PC 300. With reference to (a) to (f) of FIG. 18, processing performed in respective steps shown in the flow chart of FIG. 15 will be described.

In the step S201, the MFP controller 200 receives the print command.

Part (b) of FIG. 18 is "ccc.tif" corresponding to the color image data designated on the transparent image designating screen of "TEST PRINT SETTING".

In the step S202, the MFP controller 200 obtains the recording material information designated by the user. In the step S203, the MFP controller 200 obtains the recording material information for the sheet feeding cassette.

In the step S204, the MFP controller 200 obtains the transparent toner image data information designated by the user. This information corresponds to the transparent toner image data "ddd.tif", "eee.tif", "fff.tif" and "ggg.tif" designated by the "TEST PRINT SETTING" and is shown in (a) of FIG. 18.

In this embodiment, the image data (file) "ccc.tif" for designating the region in which the user wishes to form the color and transparent images is stored in the HDD 104. Incidentally, in the case where the image data for designating the region in which the user wishes to form the color and transparent images is not the image data such as "tif" file but is described by the PDL, the file described by the PDL is subjected to the RIP by the CPU 101 and the dedicated image processing circuit 106. As a result, the CPU 101 can prepare the color and transparent image data for selectively forming the transparent toner images in the region described by the PDL.

In the step S206, the MFP controller 200 synthesizes the transparent image data ((a) of FIG. 18) of the N patterns obtained in the step S104 on the color image data ((b) of FIG. 18) obtained in the step S201, thus preparing sample image data which can be outputted in N-in-1 manner. These sample image data are shown in (c) of FIG. 18.

The MFP controller 200 sends the transparent image data ((c) of FIG. 18) prepared in the step S206 to the printer portion 115.

Further, the MFP controller 200 sends the recording material information obtained in the step S202 to the printer portion 115.

The printer portion 115 outputs the transparent image and the color image on the recording material set in the sheet feeding cassette. Thus, a print shown in (d) of FIG. 18 is outputted.

In the step S107, the MFP controller 100 obtains the transparent image data information designated by the user. The MFP controller 200 sends the image data designated in the steps S204 and S207 to the printer portion 115. As a result, the printer portion 115 outputs the transparent image on the original set in the sheet feeding cassette. In this embodiment, the "fff.tif" is designated as the transparent image data to be outputted and therefore the image data of the "fff.tif" is outputted on the original.

As described above, by employing the constitution in this embodiment, the test mode in which the test print of the 4 patterns different in transparent image data is automatically outputted on the single sheet of the recording material is provided, so that it is possible to quickly obtain the print (output product) with an expected effect of the transparent toner. Further, it becomes possible to prevent a defective print, so that an operation efficiency can be enhanced. Other structures and functions are the same as those in the above-described First Embodiment.

[Summarization]

In the above, although several embodiments are described specifically, here, characteristic processing in the present invention will be summarized. Hereinafter, the characteristic processing refers to the processing along the flow chart (FIG. 4 or FIG. 15). The characteristic processing is constituted by roughly divided three portions. A first is obtaining of the information corresponding to the plurality of transparent image data outputted by the test printing, a second is obtaining of the synthetic sample image data to be outputted in the N-in-1 manner, and a third is obtaining of the information corresponding to the transparent image data to be outputted actually on the original. In First Embodiment, the characteristic processing was performed by the MFP 100. In Second Embodiment, the characteristic processing was performed by the information processing system consisting of the three information processing apparatuses. Specifically, the obtaining of the transparent image data was effected by the PC 300. The PC 300 and the MFP 100 sent the obtained (associated) information to the MFP controller 200. The MFP controller 200 effected the generation of the transparent image data and the color image data on the basis of the obtained test print setting information.

Thus, the characteristic processing may be executed by the single information processing apparatus or the information processing system including a plurality of information processing apparatuses.

A program for causing the information processing apparatus to execute the transparent image data forming processing of the characteristic processing is stored in the ROM 103 inside the MFP 100 in First Embodiment. Further, the program for causing the information processing apparatus to execute the transparent image data forming processing is stored in the ROM 203 inside the MFP controller 200 in Second Embodiment.

Further, the program for executing the characteristic processing may also be supplied from a remote device to the information processing system or the information processing apparatus. Further, the information processing apparatus included in the information processing system may read and execute program code stored in an external information processing apparatus.

That is, the program itself to be installed in the information processing apparatus is used for realizing the above-described processing. The form of the program is not limited so long as the information processing apparatus can execute the above-described processing by using the program.

As a recording medium for supplying the program, e.g., it is possible to use a flexible disk, a hard disk, an optical disk, a magneto-optical disk, a CD-ROM (compact-disk read-only memory), a CD-R (compact disk-recordable), a CD-RW (compact disk-rewritable), and the like. Further, as the recording medium, it is also possible to use a magnetic tape, a non-volatile memory card, an ROM, a DVD (digital versatile disk) (DVD-ROM or DVR-R (recordable)), and the like.

Further, in the MFP 100, the program may also be downloaded from the network through the I/F 114. Further, in the MFP controller 200 and the PC 300, the program may also be downloaded from a homepage (web site) on the Internet by using a browser. That is, from the homepage, the program itself or a program file which is compressed and has an auto-install function is downloaded into the recording medium such as the hard disk. Further, it is also possible to obtain the program by dividing a program constituting the program for executing the above-described processing into a plurality of files and by downloading the divided files from different homepages, respectively. That is, there is a possibility that a WWW (world wide web) server capable of downloading a program file with respect to a plurality of users constitutes a constituent feature.

Further, the program file may also be distributed to the users by being encrypted and then being stored in a storage medium such as the CD-ROM. In this case, it is also possible to permit only a user who fulfills a predetermined requirement (condition) to download key information for decrypting the encrypted program, execute the decryption of the encrypted program with the key information, and install the program into the information processing apparatus.

Incidentally, on the basis of instructions from the program, the OS running on the information processing apparatus may also execute a part or all of actual processing.

Further, the program read from the recording medium may also be written (stored) in a memory provided to a function expanding board inserted into the information processing apparatus or a function extending unit connected to the information processing apparatus. On the basis of the instructions, a CPU provided in the function expanding board or the function extending unit may also execute a part or all of the actual processing.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 133566/2011 filed Jun. 15, 2011, which is hereby incorporated by reference.

What is claimed is:

1. An image forming apparatus comprising:

an image forming portion for superposedly outputting a color toner image and a transparent toner image on a recording material;

an image data obtaining portion for obtaining a color image data to be used for forming the color toner image and first and second transparent image data to be used for forming the transparent toner image; and an executing portion for executing an operation in a test mode in which a number of test images, each of which being formed by collecting and coordinating a predetermined number of images including a first image and a second image, are outputted on the recording material, the number of test images being less than the predetermined number, wherein the first image is prepared by synthesizing and reducing the color image data and the first transparent image data which are obtained by said image data obtaining portion, and the second image is prepared by synthesizing and reducing the color image data and the second transparent image data different from the first transparent image data and an image reading portion for reading the color image formed on the recording material, wherein said image data obtaining portion obtains the color image data by reading the color image with said image reading portion.

2. An image forming apparatus according to claim 1, further comprising:

a plurality of accommodating portions for accommodating recording materials different in material;

a recording material information obtaining portion for obtaining information on the recording material on which the color image is formed; and an accommodating portion selecting portion for selecting, from the plurality of accommodating portions, the accommodating portion for accommodating the recording material corresponding to the recording material information obtained by said recording material information obtaining portion, wherein said executing portion outputs the test image on the recording material, in the operation in the test mode, accommodated in the accommodating portion selected by said accommodating portion selecting portion.

3. An image forming apparatus comprising:

an information obtaining portion configured to obtain information corresponding to (i) an original image for forming a color toner image on a recording material and (ii) a gloss adjustment area of the color toner image to be partly adjusted in gloss by forming a transparent toner image on the recording material;

an image forming portion configured to form toner images including the color toner image and the transparent toner image on the recording material using color toner and transparent toner, based on the information;

an executing portion configured to execute an operation in a test mode in which a plurality of test toner images, each including the color toner image and the transparent toner image which are supposedly formed with each other, are formed on a single recording material; and an image data generating portion configured to generate image data for forming the test toner images on the single recording material in the test mode so that an amount of the transparent toner per unit area is different in each of the test toner images.

4. An image forming apparatus according to claim 3, wherein said information obtaining portion obtains the information indicating one of the test toner images selected by an operator, and said image forming portion forms the color toner image and the transparent toner image on the recording material under an image forming condition based on the information indicating the selected one of the test toner images.

5. An image forming apparatus according to claim 4, wherein said image data generating portion generates image data for forming a symbolic image using the color toner adjacent to each of the test toner images to discriminate each of the test toner images.

6. An image forming apparatus according to claim 5, wherein the symbolic image is a numerical character image.

7. An image forming apparatus according to claim 4, further comprising an operating panel configured to input an instruction by the operator, and wherein said operating panel displays images corresponding to the test toner images for selection of one of the test toner images by the operator.

8. An image forming apparatus according to claim 3, further comprising an original image reading portion configured to read the original image, wherein said information obtaining portion obtains the information corresponding to the original image from said original image reading portion.

9. An image forming apparatus according to claim 3, wherein said image forming portion forms the color tonor image and the transparent toner image in the test mode so that the transparent toner image is on the color toner image on the recording material.

10. An image forming apparatus according to claim 9, wherein said image forming portion includes:

a color station and a transparent station, each including a photosensitive member configured to form an electronic image;

a developing member configured to develop the electrostatic image on the photosensitive member, and an intermediary transfer member configured to (i) sequentially and superposedly transfer the transparent toner image and the color toner image in the listed order and (ii) transfer the color tonor image and the transparent toner image onto the recoding material at once.

11. An image forming apparatus according to claim 3, further comprising a discharge tray configured to receive the recording material, on which the test tonor images are formed, discharged from the image forming portion.

12. An image forming apparatus according to claim 3, wherein the gloss adjustment area of the color toner image is partly adjusted in gloss by forming the transparent toner image on the recording material.

13. A controlling apparatus for controlling an image forming apparatus, comprising:

an information obtaining portion configured to obtain information corresponding to (i) an original image for forming a color toner image on a recording material using color toner and (ii) a gloss adjustment area of the color toner image to be partly adjusted in gloss by forming a transparent toner image on the recording material using transparent toner;

an executing portion configured to make the image forming apparatus execute an operation in a test mode in which a plurality of test toner images, each including the color toner image and the transparent toner image, which are superposedly formed with each other, are formed on a single recording material; and an image data generating portion configured to generate image data for forming the test toner images on the single recording material in the test mode so that an amount of the transparent toner per unit area is different in each of the test toner images.

14. A controlling apparatus according to claim 13, wherein said information obtaining portion obtains the information indicating one of the test toner images selected by an operator, and said controlling apparatus controls the image forming apparatus to form the color toner image and the transparent toner image on the recording material under an image forming condition based on the information indicating the selected one of the test toner images.

15. A controlling apparatus according to claim 14, wherein said image data generating portion generates image data for forming a symbolic image using the color toner adjacent to each of the test toner images to discriminate each of the test toner images.

16. A controlling apparatus according to claim 15, wherein the symbolic image is a numerical character image.

17. A controlling apparatus according to claim 13, wherein the gloss adjustment area of the color toner image is partly adjusted in gloss by forming the transparent toner image on the recording material.

18. A controlling apparatus for controlling an image forming apparatus, comprising:

an information obtaining portion configured to obtain information corresponding to (i) an original image for forming a color toner image on a recording material using color toner and (ii) a gloss adjustment area of the color toner image to be adjusted in gloss by forming a transparent toner image on the recording material using transparent toner;

an executing portion configured to make the image forming apparatus execute an operation in a test mode in which a plurality of test toner images, each including the color toner image and the transparent toner image which are superposedly formed with each other, are formed; and an image data generating portion configured to generate image data for forming the test toner images in the test mode so that an amount of the transparent toner per unit area is different in each of the test toner images.

19. A controlling apparatus according to claim 18, wherein said information obtaining portion obtains the information indicating one of the test toner images selected by an operator, and said controlling apparatus controls the image forming apparatus to form the color toner image and the transparent toner image on the recording material under an image forming condition based on the information indicating the selected one of the test toner images.

20. A controlling apparatus according to claim 19, wherein said image data generating portion generates image data for forming a symbolic image using the color toner adjacent to each of the test toner images to discriminate each of the test toner images.

21. A controlling apparatus according to claim 20, wherein the symbolic image is a numerical character image.

22. A controlling apparatus according to claim 18, wherein the gloss adjustment area of the color toner image is partly adjusted in gloss by forming the transparent toner image on the recording material.

* * * * *